US010216138B2

(12) United States Patent
Shimizu

(10) Patent No.: US 10,216,138 B2
(45) Date of Patent: Feb. 26, 2019

(54) DEVELOPING CARTRIDGE INCLUDING FIRST PROTRUSION AND SECOND PROTRUSION

(71) Applicant: BROTHER KOGYO KABUSHIKI KAISHA, Nagoya-shi, Aichi-ken (JP)

(72) Inventor: Keita Shimizu, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,652

(22) Filed: Sep. 29, 2017

(65) Prior Publication Data

US 2018/0284688 A1 Oct. 4, 2018

(30) Foreign Application Priority Data

Mar. 30, 2017 (JP) ..... 2017-067684

(51) Int. Cl.
*G03G 15/04* (2006.01)
*G03G 21/16* (2006.01)

(52) U.S. Cl.
CPC ..... *G03G 21/1647* (2013.01); *G03G 21/1676* (2013.01)

(58) Field of Classification Search
USPC ..... 399/107, 110, 111, 119, 120, 252, 258, 399/262
See application file for complete search history.

(56) References Cited

U.S. PATENT DOCUMENTS 9,031,458 B2 * 5/2015 Itabashi ..... G03G 21/1821 399/111
9,182,740 B2 * 11/2015 Shimizu ..... G03G 21/1821
9,342,041 B2 * 5/2016 Noda ..... G03G 21/1647
(Continued)

FOREIGN PATENT DOCUMENTS

EP 2 937 739 A1 10/2015
JP 2006-267994 A 10/2006
(Continued)

OTHER PUBLICATIONS

International Search Report and Written Opinion issued in related International Patent Ppplication No. PCT/JP2017/035478, dated Nov. 28, 2017.
(Continued)

*Primary Examiner* — Hoan Tran
(74) *Attorney, Agent, or Firm* — Merchant & Gould P.C.

(57) ABSTRACT

A developing cartridge includes: a lever movable between a first position and a second position; an urging member urging the lever toward the first position; a gear; and a first and a second protrusions that are rotatable together with the gear. During rotation of the gear from a first rotational position to a second rotational position, the first protrusion moves the lever to the second position against urging force of the urging member and then the lever moves to the first position at a first speed while contacting the first protrusion. During rotation of the gear from the second rotational position to a third rotational position, the second protrusion moves the lever to the second position against the urging force. When the gear reaches the third rotational position, the urging force moves the lever to the first position at a second speed higher than the first speed.

24 Claims, 13 Drawing Sheets

(56) References Cited

U.S. PATENT DOCUMENTS

| | | | |
|---|---|---|---|
| 2006/0193646 | A1 | 8/2006 | Suzuki et al. |
| 2008/0121169 | A1 | 5/2008 | Tsui |
| 2008/0205931 | A1 | 8/2008 | Ishikawa |
| 2011/0236062 | A1 | 9/2011 | Takagi |
| 2014/0086613 | A1 | 3/2014 | Itabashi et al. |
| 2014/0294403 | A1 | 10/2014 | Shimizu |
| 2015/0277356 | A1 | 10/2015 | Mushika |

FOREIGN PATENT DOCUMENTS

| | | | |
|---|---|---|---|
| JP | 2008-216391 | A | 9/2008 |
| JP | 2009-244563 | A | 10/2009 |
| JP | 2011-203362 | A | 10/2011 |
| JP | 2014-029439 | A | 2/2014 |
| JP | 2015-197537 | A | 11/2015 |

OTHER PUBLICATIONS

European Search Report issued in corresponding European Patent Application No. 17193960.6, dated Mar. 2, 2018.

* cited by examiner

DEVELOPING CARTRIDGE INCLUDING FIRST PROTRUSION AND SECOND PROTRUSION

CROSS REFERENCE TO RELATED APPLICATION

This application claims priority from Japanese Patent Application No. 2017-067684 filed Mar. 30, 2017. The entire content of the priority application is incorporated herein by reference.

TECHNICAL FIELD

The present disclosure relates to a developing cartridge used for an image forming apparatus.

BACKGROUND

There have been known image forming apparatuses including developing cartridges. One of such image forming apparatuses is configured to identify the specification of the developing cartridge or determine whether or not the developing cartridge is attached. For example, a prior art discloses a developing cartridge including a detection gear and protrusions moving together with rotation of the detection gear. In this configuration, an image forming apparatus senses the protrusions by means of a sensor to detect whether the developing cartridge is attached.

SUMMARY

In a case where the image forming apparatus is configured to identify the specification of the developing cartridge by detecting the protrusions thereof, the arrangement patterns of the protrusions are made different for each of a plurality of specifications. This enables the image forming apparatus to identify a developing cartridge having a specific specification from among the plurality of specifications.

In recent years, there is a demand to diversify motions of gear structures of the developing cartridges in response to diversification of the specifications of the developing cartridges.

It is therefore an object of the disclosure to provide a developing cartridge in which motion of a gear structure can be diversified in response to diversification of the specifications of the developing cartridges.

In order to attain the above and other objects, according to one aspect, the disclosure provides a developing cartridge including a casing, a lever, a first urging member, a first gear, a second gear, a first protrusion, and a second protrusion. The casing is configured to accommodate therein developing agent. The lever is movable relative to the casing between a first position and a second position, the lever being positioned at an outer surface of the casing. The first urging member is configured to urge the lever toward the first position. The first gear is rotatable about a first axis extending in a first direction, the first gear being positioned at the outer surface of the casing. The second gear is rotatable about a second axis extending in the first direction from a first rotational position to a second rotational position and further from the second rotational position to a third rotational position, the second gear being positioned at the outer surface, the second gear rotating in accordance with rotation of the first gear in a case where the second gear is in engagement with the first gear. The first protrusion is rotatable together with the second gear, the first protrusion having a first contact surface configured to contact the lever. The second protrusion is rotatable together with the second gear, the second protrusion being positioned away from the first protrusion in a rotational direction of the second gear, the second protrusion having a second contact surface extending in the rotational direction, the second contact surface being configured to contact the lever. In a case where the second gear rotates from the first rotational position to the second rotational position, the first contact surface contacts the lever to move the lever from the first position to the second position against urging force of the first urging member, and then the lever moves at a first speed from the second position to the first position in a state where the first contact surface contacts the lever. In a case where the second gear is positioned at the second rotational position, the contact between the first contact surface and the lever is released. In a case where the second gear rotates from the second rotational position to the third rotational position, the second contact surface contacts the lever to move the lever from the first position to the second position against the urging force of the first urging member. In a case where the second gear is positioned at the third rotational position, the contact between the second contact surface and the lever is released, and the lever moves at a second speed higher than the first speed from the second position to the first position by the urging force of the first urging member.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge according to one embodiment of the present disclosure will be descried in detail with reference to the accompanying drawings.

First, a laser printer 1 to which a developing cartridge 10 as an example of the developing cartridge according to the embodiment is detachably attachable will be described.

Figure 1:
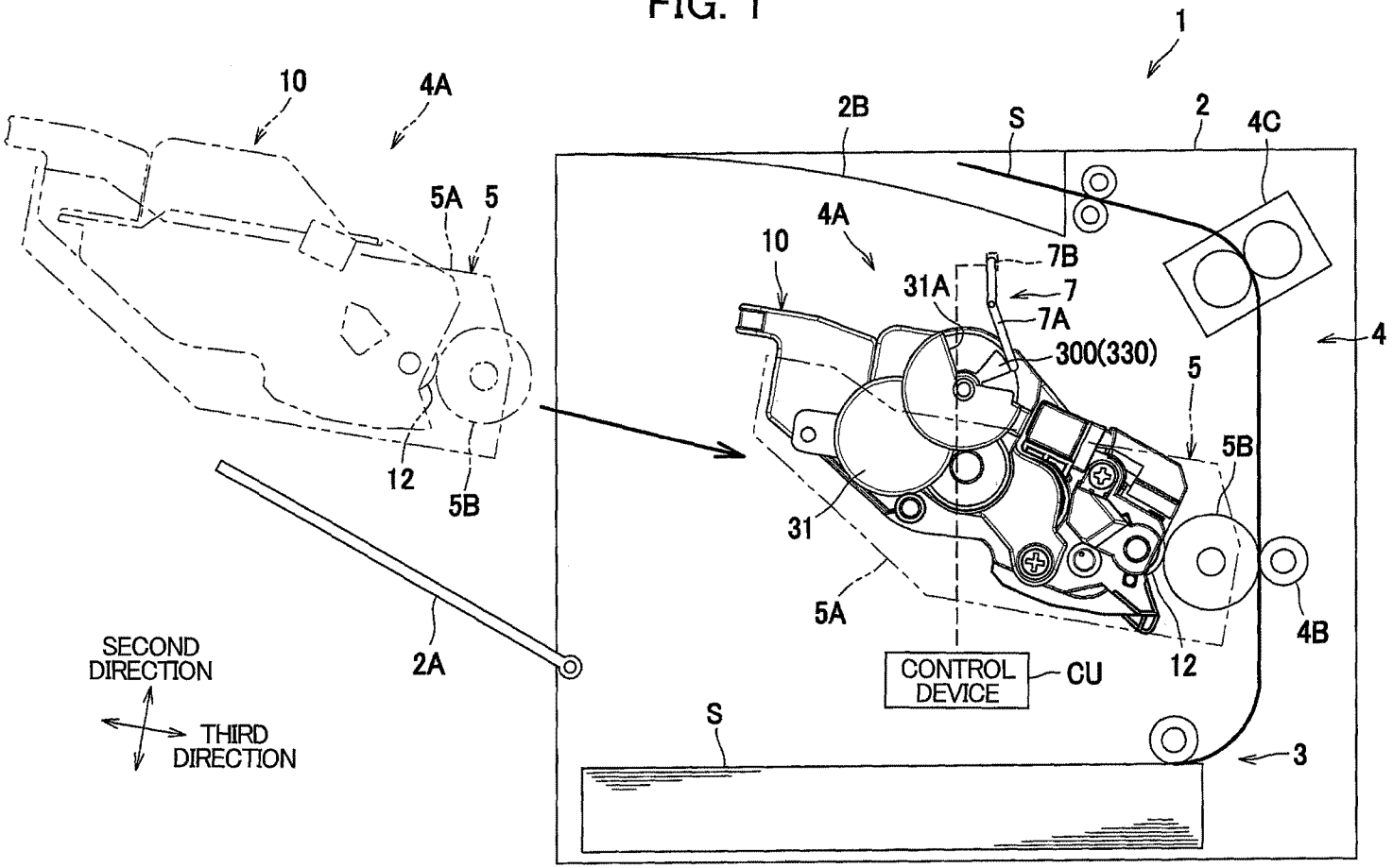
FIG. 1 is a schematic diagram illustrating a configuration of an image forming apparatus including a developing cartridge according to an embodiment of the present disclosure.

As illustrated in FIG. 1, the laser printer 1 as an example of an image forming apparatus mainly includes a main body housing 2, a sheet supply portion 3, an image forming portion 4, and a control device CU.

The main body housing 2 includes a front cover 2A and a sheet discharge tray 2B positioned at the upper portion of the main body housing 2. The main body housing 2 is internally provided with the sheet supply portion 3 and the image forming portion 4. In a state where the front cover 2A is opened, the developing cartridge 10 is detachably attached to the laser printer 1.

The sheet supply portion 3 accommodates sheets of paper S. The sheet supply portion 3 supplies the sheets S one by one to the image forming portion 4.

The image forming portion 4 includes a process cartridge 4A, an exposure device (not illustrated), a transfer roller 4B, and a fixing device 4C.

The process cartridge 4A includes a photosensitive cartridge 5, and the developing cartridge 10. The developing cartridge 10 is attachable to and detachable from the photosensitive cartridge 5. In a state where the developing cartridge 10 is attached to the photosensitive cartridge 5, the developing cartridge 10 is attached to and detached from, as the process cartridge 4A, the laser printer 1. The photosensitive cartridge 5 includes a frame 5A and a photosensitive drum 5B rotatably supported by the frame 5A.

Figure 2:
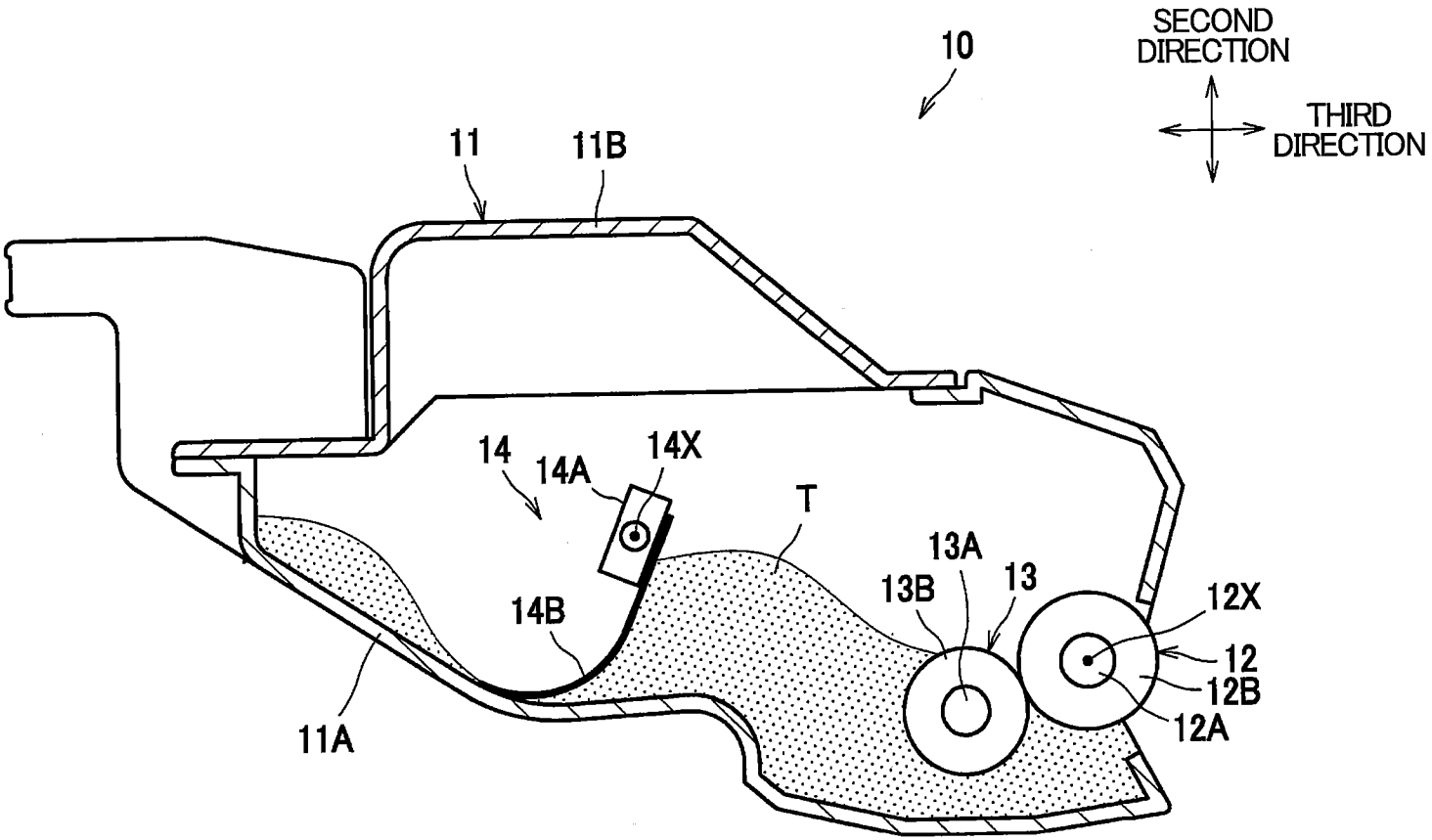
FIG. 2 is a cross-sectional view illustrating a configuration of the developing cartridge.

As illustrated in FIG. 2, the developing cartridge 10 includes a casing 11, a developing roller 12, a supply roller 13, and an agitator 14.

The casing 11 includes a container 11A and a lid 11B. The container 11A of the casing 11 is configured to accommodate therein toner T. The toner T is an example of developing agent.

The developing roller 12 includes a developing roller shaft 12A extending in a first direction and a roller portion 12B. The first direction is identical to an axial direction of a second agitator gear 100 (described later). Hereinafter, the first direction is also simply referred to as the axial direction. The roller portion 12B covers the outer circumferential surface of the developing roller shaft 12A. The roller portion 12B is made of, for example, electrically conductive rubber.

The developing roller 12 is rotatable about the developing roller shaft 12A. In other words, the developing roller 12 is rotatable about a fourth axis 12X extending in the first direction. The developing roller 12 is supported by the casing 11 so as to be rotatable about the developing roller shaft 12A. That is, the roller portion 12B of the developing roller 12 is rotatable together with the developing roller shaft 12A. The developing roller 12 is applied with a developing bias by the control device CU.

The container 11A and the lid 11B of the casing 11 face each other in a second direction. The second direction crosses the first direction. Preferably, the second direction is orthogonal to the first direction. The developing roller 12 is positioned at one end portion of the casing 11 in a third direction. The third direction crosses the first direction and the second direction. Preferably, the third direction is orthogonal to both the first direction and the second direction.

The supply roller 13 includes a supply roller shaft 13A extending in the first direction and a roller portion 13B. The roller portion 13B covers the outer circumferential surface of the supply roller shaft 13A. The roller portion 13B is made of, for example, sponge. The supply roller 13 is rotatable about the supply roller shaft 13A. That is, the roller portion 13B of the supply roller 13 is rotatable together with the supply roller shaft 13A.

The agitator 14 includes an agitator shaft 14A and a flexible sheet 14B. The agitator shaft 14A is an example of a shaft. The agitator shaft 14A extends in the first direction. The agitator shaft 14A is rotatable about a first axis 14X extending in the first direction. The agitator shaft 14A is supported by the casing 11 so as to be rotatable about the first axis 14X. That is, the agitator 14 is rotatable about the first axis 14X. The agitator shaft 14A is configured to rotate in accordance with rotation of a coupling 22 (described later). The flexible sheet 14B has a base end fixed to the agitator shaft 14A and a leading end configured to contact the inner surface of the casing 11. The agitator 14 is configured to agitate the toner T by making use of the rotating flexible sheet 14B.

As illustrated in FIG. 1, the transfer roller 4B faces the photosensitive drum 5B. The transfer roller 4B conveys the sheet S while nipping the sheet S between the transfer roller 4B and the photosensitive drum 5B.

The photosensitive drum 5B is charged by a charger (not illustrated) and is exposed to light by the exposure device, whereby an electrostatic latent image is formed on the photosensitive drum 5B. The developing cartridge 10 supplies the toner T to the electrostatic latent image to form a toner image on the photosensitive drum 5B. The toner image formed on the photosensitive drum 5B is transferred onto the sheet S supplied from the sheet supply portion 3 while the sheet S passes through between the photosensitive drum 5B and the transfer roller 4B.

The fixing device 4C thermally fixes the toner image transferred to the sheet S to the sheet S. The sheet S to which the toner image has been thermally fixed is discharged onto the sheet discharge tray 2B outside the main body housing 2.

The control device CU is a device which controls the entire operation of the laser printer 1.

The laser printer 1 has a sensor 7. The sensor 7 is configured to detect whether or not the developing cartridge 10 is a new cartridge, and further detect the specification of the developing cartridge 10. The sensor 7 includes a main body lever 7A and an optical sensor 7B.

The main body lever 7A is swingably supported by the main body housing 2. The main body lever 7A is positioned at a position where the main body lever 7A can contact a detection lever 300 described later.

The optical sensor 7B is connected to the control device CU and outputs a detection signal to the control device CU. The control device CU is configured to identify the specification and the like of the developing cartridge 10 on the basis of the detection signal received from the optical sensor 7B. The optical sensor 7B detects displacement of the main body lever 7A and transmits the detection signal to the control device CU. More specifically, for example, a sensor unit including a light-emitting portion and a light-receiving portion is employed as the optical sensor 7B. The details will be described later.

Figure 3:
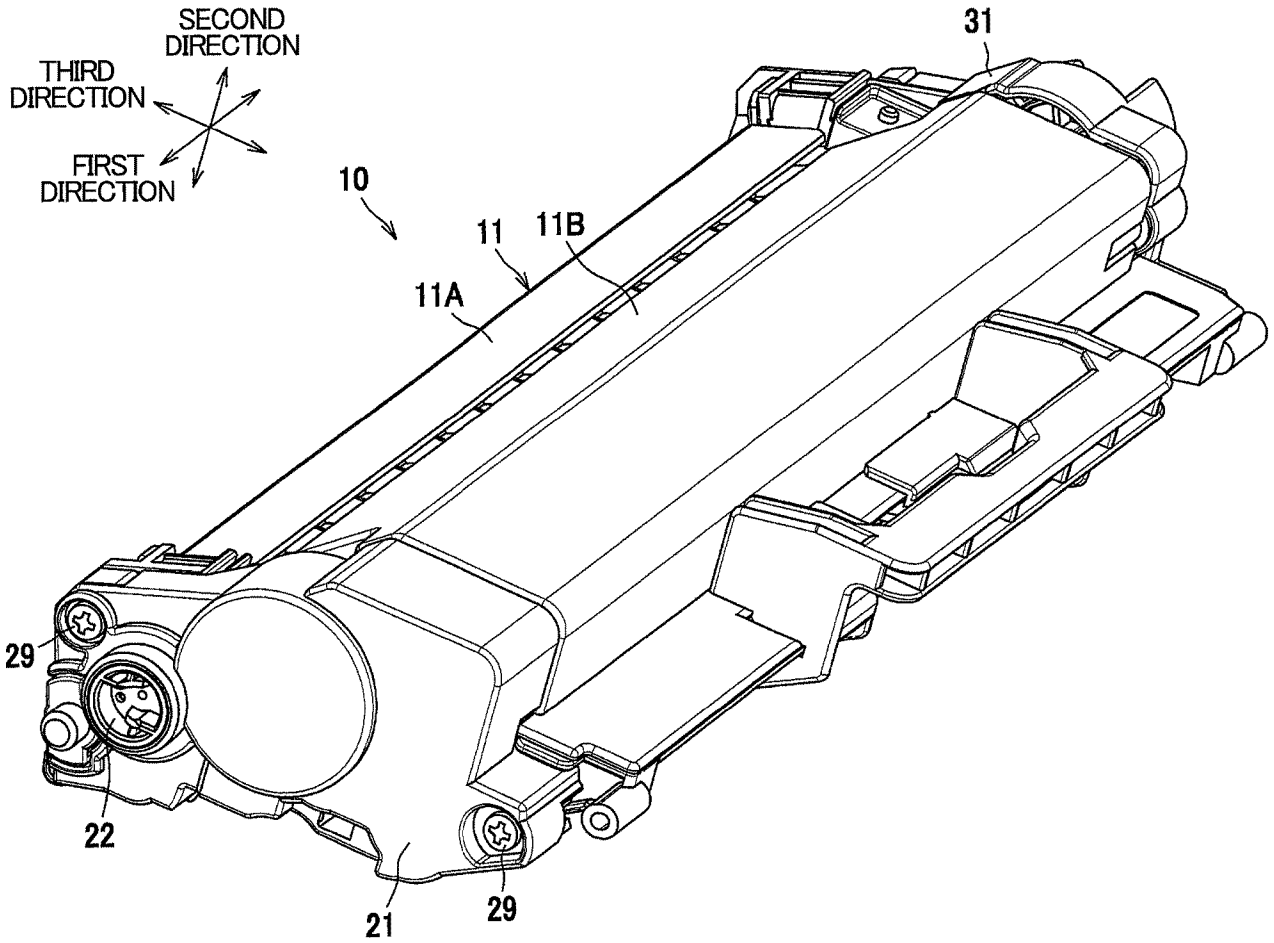
FIG. 3 is a perspective view illustrating one side in a first direction of the developing cartridge.
Figure 4:
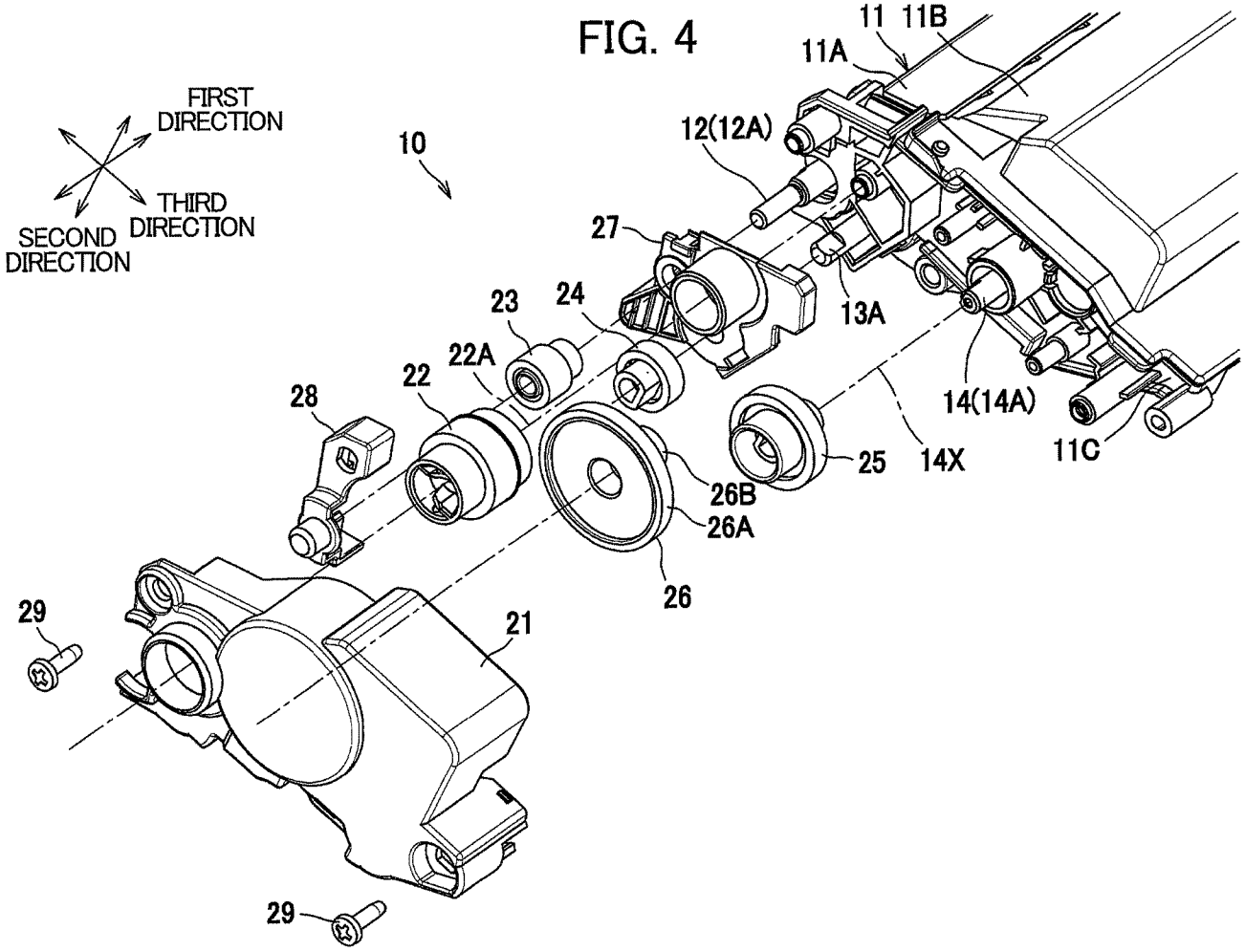
FIG. 4 is an exploded perspective view of parts positioned at one side in the first direction of a casing of the developing cartridge.

Next, the configuration of the developing cartridge 10 will be described in detail. As illustrated in FIGS. 3 and 4, the developing cartridge 10 includes a first gear cover 21, the coupling 22, a developing gear 23, a supply gear 24, a first agitator gear 25, an idle gear 26, a first bearing member 27, and a cap 28. The first gear cover 21, the coupling 22, the developing gear 23, the supply gear 24, the first agitator gear 25, the idle gear 26, the first bearing member 27, and the cap 28 are positioned at one side of the casing 11 in the first direction.

The first gear cover 21 includes a shaft (not illustrated) and supports the idle gear 26 at the shaft. The first gear cover 21 covers at least one of the gears positioned at the one side of the casing 11 in the first direction. The first gear cover 21 is fixed to an outer surface 11C with screws 29. The outer surface 11C is an outer surface positioned at the one side of the casing 11 in the first direction.

Note that, in the present specification, "gear" is not limited to a member which has gear teeth and transmits a rotational force through the gear teeth, but includes a member which transmits a rotational force by a friction transmission.

The coupling 22 is rotatable about a fifth axis 22A extending in the first direction. The coupling 22 is positioned at the one side of the casing 11 in the first direction. That is, the coupling 22 is positioned at the outer surface 11C. The coupling 22 is rotatable by receiving drive force. More specifically, the coupling 22 can receive drive force from the laser printer 1. The laser printer 1 includes a drive member (not illustrated), and the coupling 22 is rotatable by engaging with the drive member. The coupling 22 has a recessed portion which is recessed in the first direction. The recessed portion is configured to receive the drive member and to engage with the drive member. More specifically, engagement of the recessed portion with the drive member enables the recessed portion to receive drive force from the laser printer 1.

The developing gear 23 is mounted to the developing roller shaft 12A and is rotatable in accordance with rotation of the coupling 22. The developing gear 23 is positioned at the one side of the casing 11 in the first direction. That is, the developing gear 23 is positioned at the outer surface 11C.

The supply gear 24 is mounted to the supply roller shaft 13A and is rotatable in accordance with the rotation of the coupling 22. The supply gear 24 is positioned at the one side of the casing 11 in the first direction. That is, the supply gear 24 is positioned at the outer surface 11C.

The first agitator gear 25 is positioned at the one side of the casing 11 in the first direction. That is, the first agitator gear 25 is positioned at the outer surface 11C. The first agitator gear 25 is mounted to the agitator shaft 14A of the agitator 14 and is rotatable together with the agitator 14 in accordance with the rotation of the coupling 22.

The idle gear 26 is positioned at the one side of the casing 11 in the first direction. That is, the idle gear 26 is positioned at the outer surface 11C. The idle gear 26 includes a large diameter portion 26A in engagement with the gear teeth of the coupling 22 and a small diameter portion 26B in engagement with the gear teeth of the first agitator gear 25. The idle gear 26 is rotatably supported by the shaft (not illustrated) of the first gear cover 21. The idle gear 26 decelerates rotation of the coupling 22 and transmits the decelerated rotation to the first agitator gear 25. Incidentally, the large diameter portion 26A is positioned farther from the casing 11 in the first direction than the small diameter portion 26B is from the casing 11.

The first bearing member 27 axially supports the coupling 22, the developing gear 23, and the supply gear 24. The first bearing member 27 is fixed to the one side of the casing 11 in the first direction.

The cap 28 covers one end portion of the developing roller shaft 12A in the first direction. The first gear cover 21 and the cap 28 may be made of mutually different resins.

Figure 5:
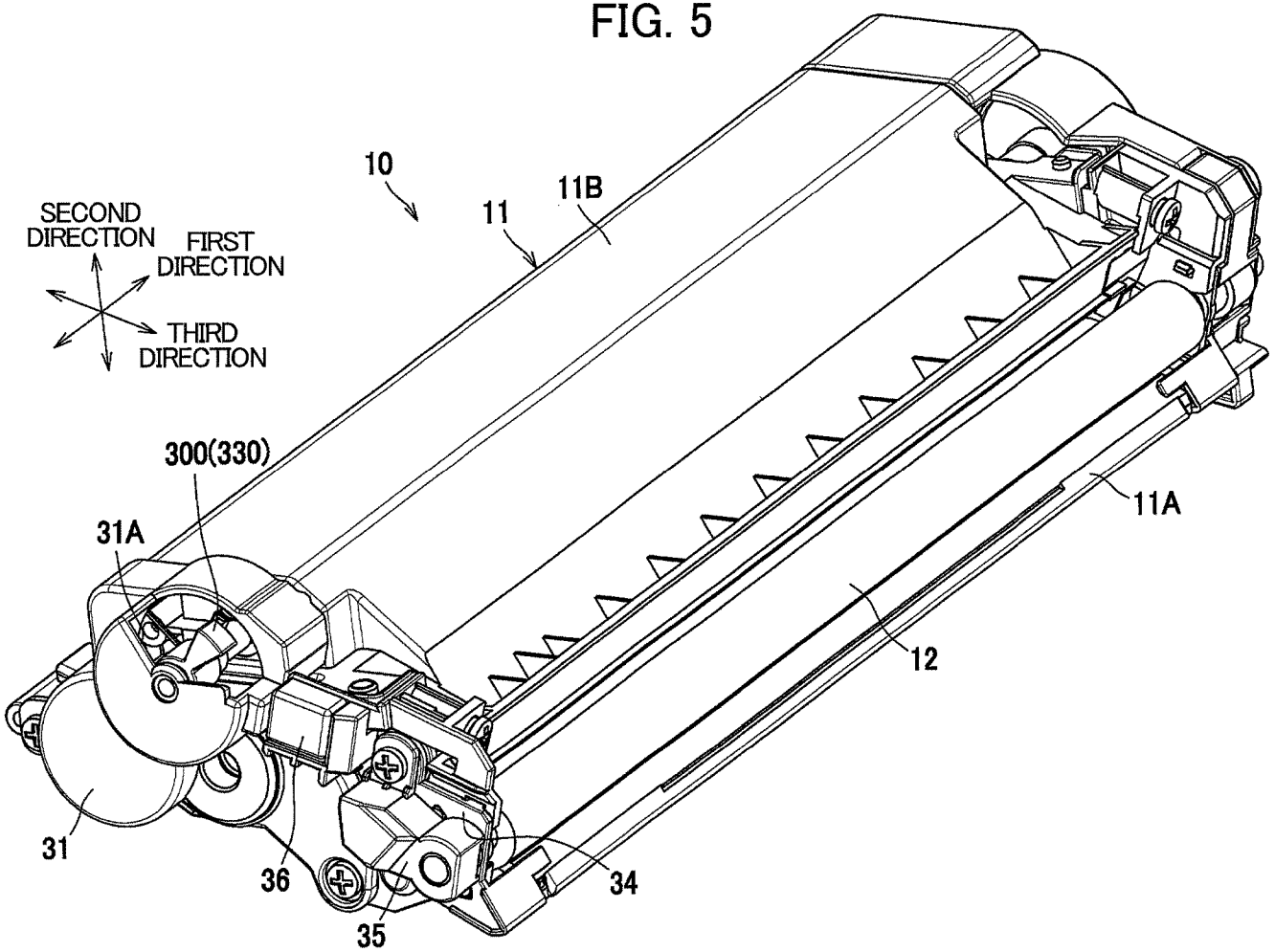
FIG. 5 is a perspective view illustrating another side in the first direction of the developing cartridge.
Figure 6:
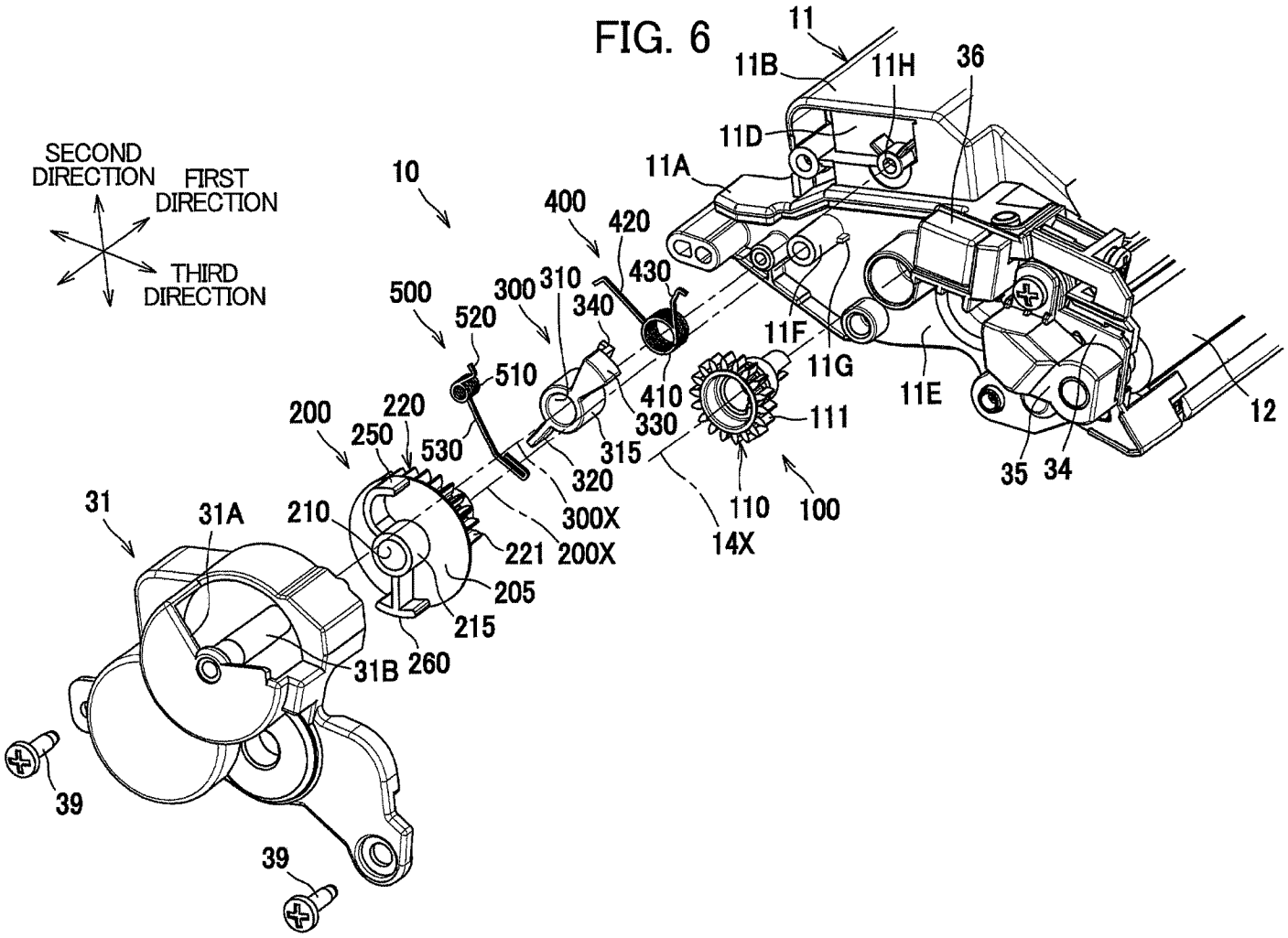
FIG. 6 is an exploded perspective view of parts of a gear structure positioned at another side in the first direction of the casing of the developing cartridge.

As illustrated in FIGS. 5 and 6, the developing cartridge 10 includes a second gear cover 31 as an example of a cover, the second agitator gear 100 as an example of a first gear, a detection gear 200 as an example of a second gear, the detection lever 300 as an example of a lever, a torsion spring 400 as an example of a first urging member, a torsion spring 500 as an example of a second urging member, a second bearing member 34, a developing electrode 35, and a supply electrode 36. The second gear cover 31, the second agitator gear 100, the detection gear 200, the detection lever 300, the torsion spring 400, the torsion spring 500, the second bearing member 34, the developing electrode 35, and the supply electrode 36 are positioned at another side of the casing 11 in the first direction.

The second gear cover 31 covers at least a portion of the detection lever 300. The second gear cover 31 covers a portion of the detection lever 300, the second agitator gear 100, and the detection gear 200. The second gear cover 31 is positioned at an outer surface 11E, which is positioned at another side in the first direction of the container 11A of the casing 11. The second gear cover 31 has an opening 31A. The second gear cover 31 includes a lever shaft 31B extending in the first direction. The second gear cover 31 is fixed to the outer surface 11E with screws 39.

At least a portion of the detection lever 300 is exposed through the opening 31A. More specifically, a lever contact portion 330 (described later) of the detection lever 300 is exposed through the opening 31A.

As illustrated in FIG. 6, the second agitator gear 100 is positioned at the other side of the casing 11 in the first direction. That is, the second agitator gear 100 is positioned at the outer surface 11E which is positioned at the other side of the container 11A of the casing 11 in the first direction. The second agitator gear 100 is mounted to the agitator shaft 14A of the agitator 14. Thus, the second agitator gear 100 is rotatable about the first axis 14X together with the agitator shaft 14A. That is, the second agitator gear 100 is rotatably supported by the casing 11.

The second agitator gear 100 includes a first gear portion 110. The first gear portion 110 includes a plurality of gear teeth 111. As an example, the first gear portion 110 has the gear teeth 111 provided over the entire circumferential periphery of the second agitator gear 100.

The detection gear 200 is positioned at the other side of the casing 11 in the first direction. That is, the detection gear 200 is positioned at the outer surface 11E. The detection gear 200 is rotatable about a second axis 200X extending in the axial direction. The detection gear 200 rotates in accordance with rotation of the second agitator gear 100 in a case where the detection gear 200 is in engagement with the second agitator gear 100.

The detection gear 200 includes a tubular portion 215 having a hole 210. The casing 11 includes a shaft 11F protruding from the outer surface 11E and extending in the first direction. The casing 11 further includes a locking protrusion 11G protruding outward in the radial direction from the shaft 11F. Further, the locking protrusion 11G protrudes in the axial direction from the outer surface 11E of the casing 11. The shaft 11F is inserted into the hole 210, and thus the detection gear 200 is rotatable about the shaft 11F. That is, the detection gear 200 is rotatably supported by the casing 11.

Figure 9A:
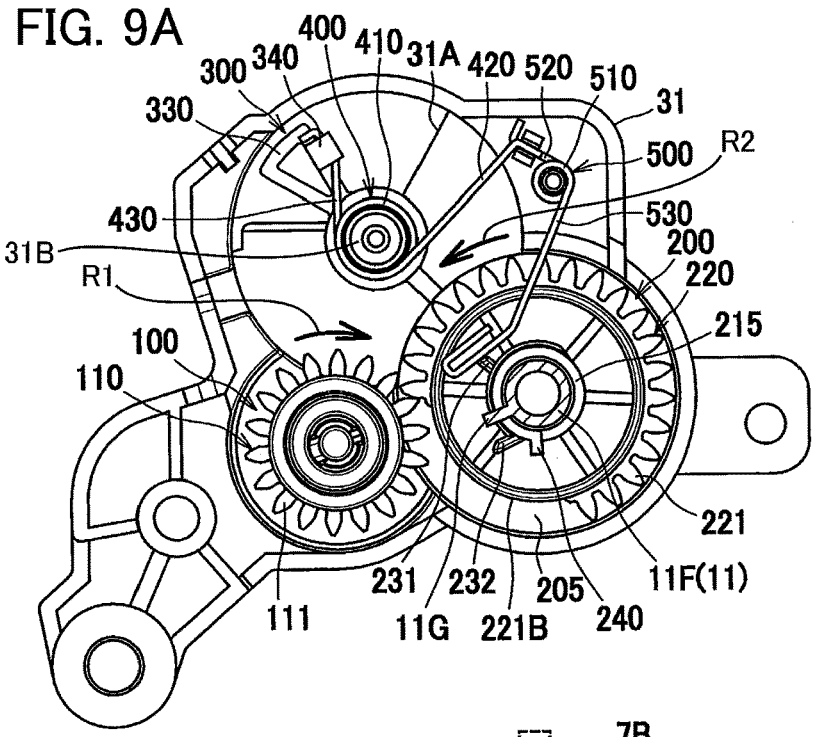
FIG. 9A is a view illustrating the detection gear and a detection lever as viewed from the inside of the developing cartridge, the view illustrating a state where the detection gear is positioned at an initial position.

The detection gear 200 includes a disk portion 205 extending in a direction crossing the axial direction. Preferably, the disk portion 205 extends in a direction orthogonal to the axial direction. As illustrated in FIG. 9A, the detection gear 200 includes a second gear portion 220 as an example of a gear portion, a first spring engagement portion 231, a second spring engagement portion 232, and a locking protrusion 240. The second gear portion 220, the first spring engagement portion 231, the second spring engagement portion 232, and the locking protrusion 240 are positioned at one side of the disk portion 205 in the first direction.

The second gear portion 220 includes a plurality of gear teeth 221. The second gear portion 220 is positioned at a portion of the circumferential periphery of the detection gear 200. The detection gear 200 includes a tooth-missing portion 221B. The tooth-missing portion 221B is positioned at a portion other than the second gear portion 220 on the circumferential periphery of the detection gear 200, and the portion is at the same position in the axial direction as the second gear portion 220. That is, the tooth-missing portion 221B is at the same position in the axial direction as the second gear portion 220. The tooth-missing portion 221B has no gear teeth 221.

The first spring engagement portion 231 and the second spring engagement portion 232 protrude outward in the radial direction of the detection gear 200 from the tubular portion 215. Further, the first spring engagement portion 231 and the second spring engagement portion 232 protrude in the axial direction from the disk portion 205. The first spring engagement portion 231 and the second spring engagement portion 232 each have a plate shape. Each of the first spring engagement portion 231 and the second spring engagement portion 232 receives force from the torsion spring 500 by engaging with the torsion spring 500. The first spring engagement portion 231, the second spring engagement portion 232, and the locking protrusion 240 are positioned away from one another in the rotational direction of the detection gear 200.

The locking protrusion 240 protrudes outward in the radial direction of the detection gear 200 from the leading end of the tubular portion 215 which is positioned at one side of the tubular portion 215 in the first direction. The locking protrusion 240 is rotatable together with the detection gear 200. That is, the detection gear 200 includes the locking protrusion 240. More specifically, the locking protrusion 240 is formed integrally with the detection gear 200. The locking protrusion 240 engages with the locking protrusion 11G of the casing 11 to define the posture of the detection gear 200 after rotation of the detection gear 200.

Figure 9B:
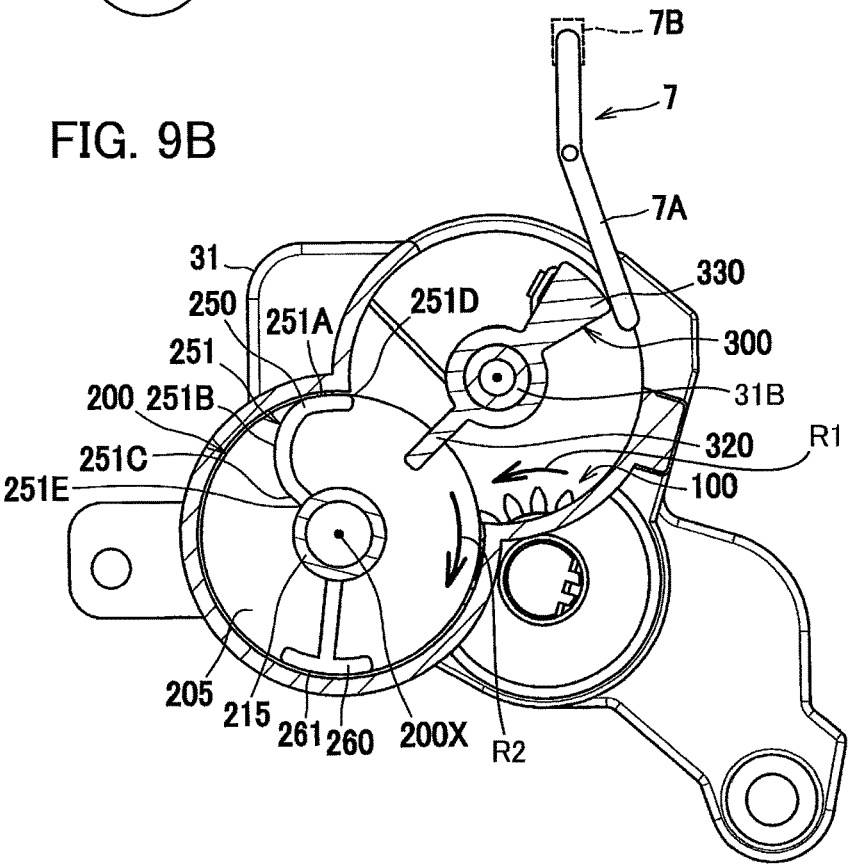
FIG. 9B is a view illustrating the detection gear and the detection lever as viewed from the outside of the developing cartridge, the view illustrating the state where the detection gear is positioned at the initial position.

As illustrated in FIGS. 6 and 9B, the detection gear 200 includes a first protrusion 250 and a second protrusion 260, both of which are positioned at another side of the disk portion 205 in the first direction.

The first protrusion 250 protrudes in the axial direction. Further, the first protrusion 250 protrudes in the radial direction of the detection gear 200. More specifically, the first protrusion 250 protrudes in the axial direction from the disk portion 205. The first protrusion 250 protrudes outward in the radial direction of the detection gear 200 from the tubular portion 215. The first protrusion 250 is rotatable together with the detection gear 200. That is, the detection gear 200 includes the first protrusion 250. More specifically, the first protrusion 250 is formed integrally with the detection gear 200.

The first protrusion 250 has a first contact surface 251. The first contact surface 251 is configured to contact the detection lever 300. The first contact surface 251 extends in a direction opposite to the rotational direction of the detection gear 200, and further extends inward in the radial direction of the detection gear 200. Note that, hereinafter, the direction opposite to the rotational direction of the detection gear 200 will be simply referred to as "opposite direction." The first contact surface 251 has a curved shape which is convex in the opposite direction. More specifically, the first contact surface 251 includes a first surface 251A, a second surface 251B, and a third surface 251C.

The first surface 251A extends in the opposite direction. The first surface 251A extends along the outer circumferential surface of the disk portion 205.

The second surface 251B extends from the end portion in the opposite direction of the first surface 251A. The second surface 251B extends inward in the radial direction of the detection gear 200 and is curved to be convex in the opposite direction.

The third surface 251C extends in the radial direction of the detection gear 200 from the end portion of the second surface 251B in the radial direction of the detection gear 200.

The first contact surface 251 has a first end portion 251D and a second end portion 251E. The first end portion 251D is one end portion of the first contact surface 251 in the rotational direction of the detection gear 200. The second end portion 251E is another end portion of the first contact surface 251 in the rotational direction of the detection gear 200. The second end portion 251E is positioned away from the first end portion 251D in the rotational direction of the detection gear 200. The second end portion 251E is positioned closer to the second axis 200X in the radial direction of the detection gear 200 than the first end portion 251D is to the second axis 200X.

The second protrusion 260 protrudes in the axial direction. The second protrusion 260 further protrudes in the radial direction of the detection gear 200. More specifically, the second protrusion 260 protrudes in the axial direction from the disk portion 205. Further, the second protrusion 260 protrudes outward in the radial direction of the detection gear 200 from the tubular portion 215. The second protrusion 260 is positioned away from the first protrusion 250 in the rotational direction of the detection gear 200. The second protrusion 260 is rotatable together with the detection gear 200. That is, the detection gear 200 includes the second protrusion 260. More specifically, the second protrusion 260 is formed integrally with the detection gear 200.

The second protrusion 260 has a second contact surface 261. The second contact surface 261 is configured to contact the detection lever 300. The second contact surface 261 extends in the rotational direction of the detection gear 200. The second contact surface 261 extends along the outer circumferential surface of the disk portion 205.

As illustrated in FIG. 6, the torsion spring 500 has a coil portion 510, a first arm 520, and a second arm 530. The torsion spring 500 is an example of a spring. The first arm 520 extends from one end of the coil portion 510. The second arm 530 extends from another end of the coil portion 510 and is configured to contact the detection gear 200. As illustrated in FIG. 9A, the first arm 520 is in contact with and fixed to the second gear cover 31. Alternatively, the first arm 520 may be in contact with and fixed to the casing 11.

Incidentally, for example, the fixed state of the first arm 520 to the second gear cover 31 (or the casing 11) may include a state where the first arm 520 is slightly movable relative to the second gear cover 31 (or the casing 11) with a slight play therebetween.

In the state illustrated in FIG. 9A, the torsion spring 500 urges the detection gear 200 in the rotational direction of the detection gear 200. Specifically, the second arm 530 is in contact with the first spring engagement portion 231 of the detection gear 200 and urges the detection gear 200 in the rotational direction of the detection gear 200. Further, in the state illustrated in FIG. 12A, the torsion spring 500 holds the detection gear 200 at a final position (described later). Specifically, the second arm 530 is in contact with the second spring engagement portion 232 of the detection gear 200 and urges the detection gear 200 in the rotational direction of the detection gear 200.

As illustrated in FIG. 6, the detection lever 300 is positioned at the other side of the casing 11 in the first direction. That is, the detection lever 300 is positioned at the outer surface 11E of the casing 11. The detection lever 300 is movable relative to the casing 11. More specifically, the detection lever 300 is swingably movable about a third axis 300X extending in the axial direction.

The detection lever 300 includes a tubular portion 315 having a hole 310. The lever shaft 31B of the second gear cover 31 is inserted into the hole 310 of the tubular portion 315, and the detection lever 300 is swingably movable about the lever shaft 31B. That is, the detection lever 300 is swingably supported by the second gear cover 31. The leading end of the lever shaft 31B is inserted into and supported by a support hole 11H which is formed at a side wall 11D positioned at another side of the lid 11B of the casing 11 in the first direction.

The detection lever 300 includes a gear contact portion 320, the lever contact portion 330, and a spring engagement portion 340.

The gear contact portion 320 extends outward from the tubular portion 315 in the radial direction of the tubular portion 315. The gear contact portion 320 has a plate shape. The gear contact portion 320 is positioned at a position where the leading end of the gear contact portion 320 can contact the first protrusion 250 and the second protrusion 260 of the detection gear 200.

The lever contact portion 330 extends outward from the tubular portion 315 in the radial direction of the tubular portion 315. The lever contact portion 330 is positioned opposite to the gear contact portion 320 with respect to the tubular portion 315. The lever contact portion 330 extends in a direction opposite to the extending direction of the gear contact portion 320 in the radial direction of the tubular portion 315. The lever contact portion 330 is positioned at a position where the leading end of the lever contact portion 330 can contact the main body lever 7A.

The spring engagement portion 340 protrudes in the axial direction from the lever contact portion 330 and extends in the circumferential direction of the tubular portion 315. The spring engagement portion 340 is in engagement with the torsion spring 400 and receives force from the torsion spring 400.

The torsion spring 400 includes a coil portion 410, a first arm 420, and a second arm 430. The torsion spring 400 is an example of a spring. The first arm 420 extends from one end of the coil portion 410. The second arm 430 extends from another end of the coil portion 410. As illustrated in FIG. 9A, the first arm 420 is in contact with and fixed to the second gear cover 31. Alternatively, the first arm 420 may be in contact with and fixed to the casing 11.

Incidentally, for example, the fixed state of the first arm 420 to the second gear cover 31 (or the casing 11) may include a state where the first arm 420 is slightly movable relative to the second gear cover 31 (or the casing 11) with a slight play therebetween.

The torsion spring 400 urges the detection lever 300 to a first position (described later). Specifically, the second arm 430 is in contact with the spring engagement portion 340 of the detection lever 300 and urges the detection lever 300 toward the position illustrated in FIG. 9A.

The detection lever 300 is swingably movable between the first position and a second position. The first position is the position illustrated in FIGS. 9A and 9B. The second position is, for example, the positions illustrated in FIGS. 10A and 11A to which the detection lever 300 swingably moves from the first position due to contact between the gear contact portion 320 and the first protrusion 250 or the second protrusion 260 of the detection gear 200. The detection lever 300 can be returned from the second position to the first position by the urging force of the torsion spring 400.

Figure 10A:
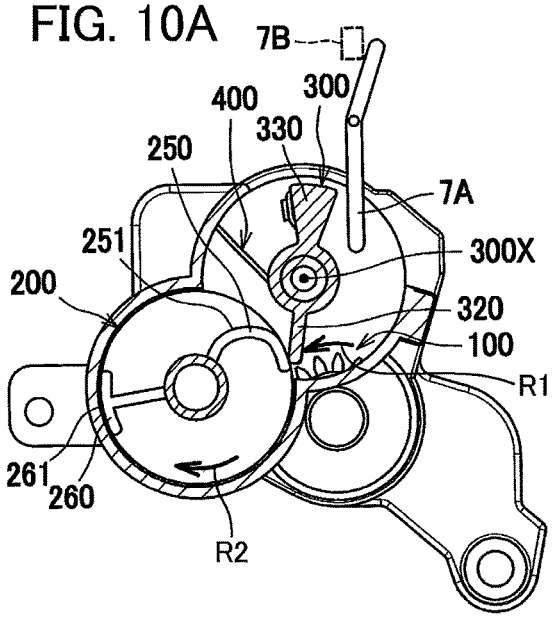
FIG. 10A is a view illustrating the detection gear and the detection lever as viewed from the outside of the developing cartridge, the view illustrating a process of rotation of the detection gear from the initial position to a second rotational position.
Figure 11A:
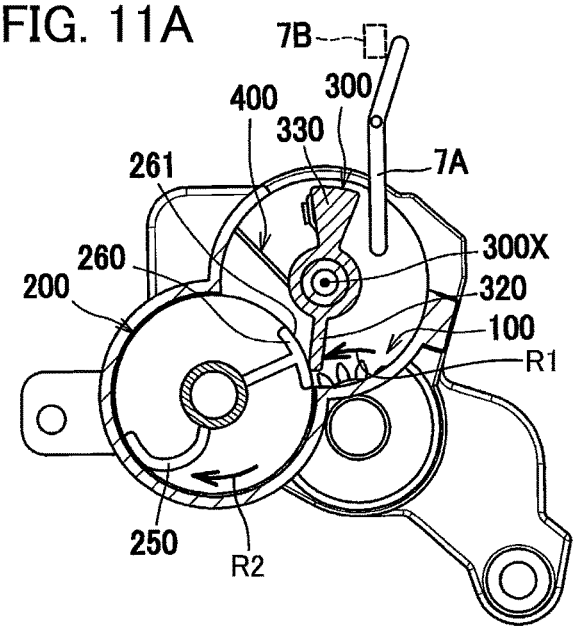
FIG. 11A is a view illustrating the detection gear and the detection lever as viewed from the outside of the developing cartridge, the view illustrating a process of rotation of the detection gear from the second rotational position to a third rotational position.

As illustrated in FIG. 9B, when the detection lever 300 is at the first position in a state where the developing cartridge 10 is attached to the laser printer 1, the lever contact portion 330 contacts the main body lever 7A. On the other hand, as illustrated in FIGS. 10A and 11A, when the detection lever 300 is at the second position in a state where the developing cartridge 10 is attached to the laser printer 1, the lever contact portion 330 is out of contact with the main body lever 7A. The main body lever 7A is an example of a portion of an image forming apparatus.

In a case where the developing cartridge 10 is in an unused state, the detection gear 200 is positioned at the position illustrated in FIGS. 9A and 9B, relative to the second gear cover 31. Hereinafter, the positions of the second agitator gear 100 and the detection gear 200 illustrated in FIGS. 9A and 9B are each referred to as an initial position. The initial position of the detection gear 200 is an example of a first rotational position.

When the detection gear 200 is positioned at the initial position, the developing cartridge 10 is in an unused state. As illustrated in FIG. 9B, when the detection gear 200 is positioned at the initial position, the detection lever 300 is positioned at the first position and the leading end of the lever contact portion 330 is in contact with the main body lever 7A. As a result, the main body lever 7A is positioned between the light-emitting portion and the light-receiving portion of the optical sensor 7B, thereby causing light emitted from the light-emitting portion to be shielded by the main body lever 7A.

The detection gear 200 is rotatable about the second axis 200X from the initial position to a second rotational position. The second rotational position is the position illustrated in FIG. 10C where contact between the first contact surface 251 of the first protrusion 250 and the gear contact portion 320 of the detection lever 300 is released. Further, the detection gear 200 is rotatable from the second rotational position to a third rotational position. The third rotational position is the position illustrated in FIG. 11B where contact between the second contact surface 261 of the second protrusion 260 and the gear contact portion 320 of the detection lever 300 is released. Further, the detection gear 200 is rotatable from the third rotational position to a final position. The final position is the position illustrated in FIGS. 12A and 12B (described later). The final position is an example of a fourth rotational position.

When the detection gear 200 rotates from the initial position to the third rotational position, at least one of the plurality of gear teeth 221 of the second gear portion 220 engages with at least one of the plurality of gear teeth 111 of the first gear portion 110 of the second agitator gear 100 as illustrated in, for example, FIG. 9A.

Figure 12A:
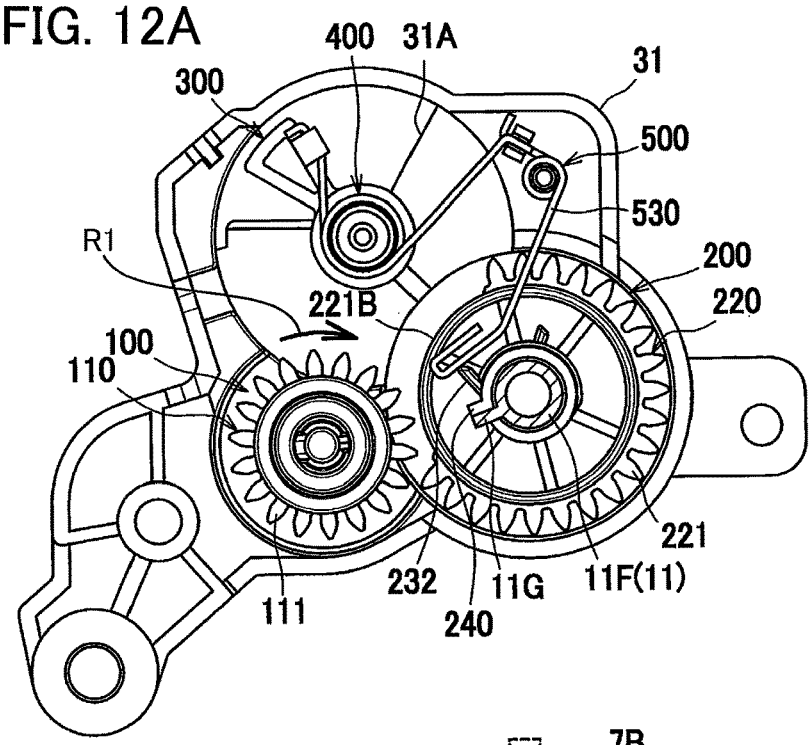
FIG. 12A is a view illustrating the detection gear and the detection lever as viewed from the inside of the developing cartridge, the view illustrating a state where the detection gear is positioned at a final position.
Figure 12B:
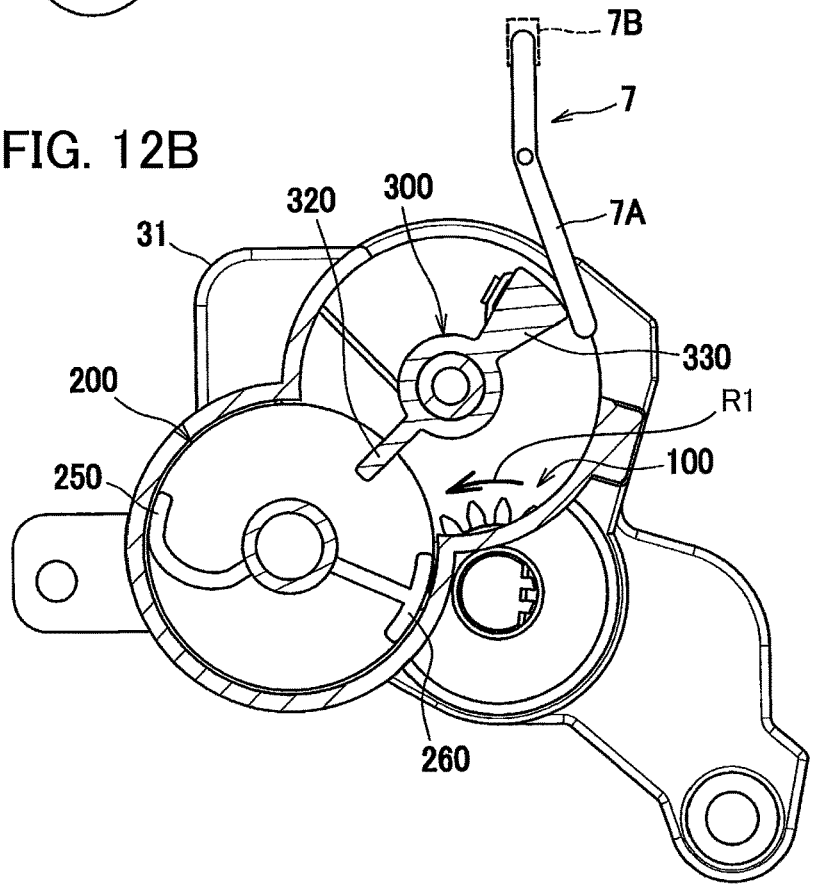
FIG. 12B is a view illustrating the detection gear and the detection lever as viewed from the outside of the developing cartridge, the view illustrating the state where the detection gear is positioned at the final position.

When the detection gear 200 is at the final position illustrated in FIGS. 12A and 12B, the engagement between the second gear portion 220 and the first gear portion 110 of the second agitator gear 100 is released. In this case, none of the plurality of gear teeth 221 of the second gear portion 220 is in engagement with the plurality of gear teeth 111 of the first gear portion 110. When the detection gear 200 is at the final position, the first gear portion 110 of the second agitator gear 100 faces the tooth-missing portion 221B of the second gear portion 220.

The detection gear 200 rotates from the initial position illustrated in FIG. 9A to the final position illustrated in FIG. 12A via the second rotational position and the third rotational position, and then is stopped. That is, the detection gear 200 is rotatable from the initial position to the final position. In a state where the detection gear 200 is positioned at the final position, the torsion spring 500 is in contact with the second spring engagement portion 232 and urges the detection gear 200 in the rotational direction of the detection gear 200. At the final position of the detection gear 200, the locking protrusion 240 is in contact with the locking protrusion 11G and is pressed against the locking protrusion 11G by the urging force of the torsion spring 500.

Although details will be described later, when the detection gear 200 rotates from the initial position illustrated in FIG. 9B to the second rotational position, the first protrusion 250 contacts the gear contact portion 320 of the detection lever 300 as illustrated in FIG. 10A to move the detection lever 300 from the first position to the second position. Further, when the detection gear 200 rotates from the second rotational position to the third rotational position, the second protrusion 260 contacts the gear contact portion 320 of the detection lever 300 as illustrated in FIG. 11A to move the detection lever 300 from the first position to the second position. In these cases, i.e., in a state where the detection lever 300 is positioned at the second position, the detection lever 300 is out of contact with the main body lever 7A, and the main body lever 7A is not positioned between the light-emitting portion and the light-receiving portion of the optical sensor 7B. As a result, light emitted from the light-emitting portion is not shielded by the main body lever 7A, thereby allowing the light-receiving portion to receive the light emitted from the light-emitting portion.

Figure 10B:
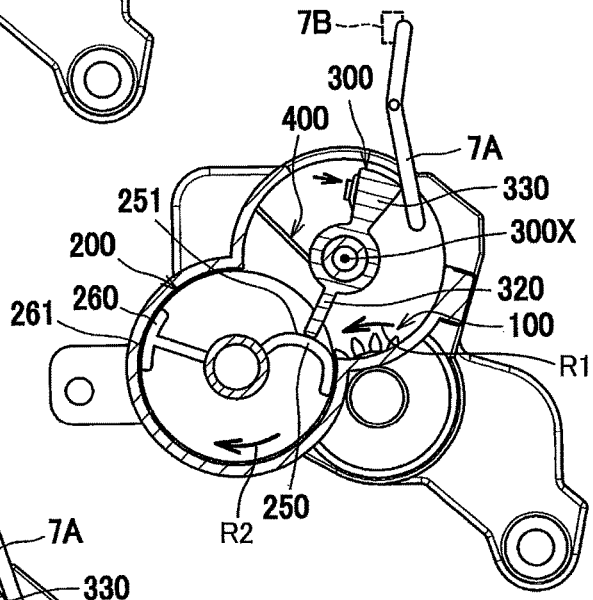
FIG. 10B is a view illustrating the detection gear and the detection lever as viewed from the outside of the developing cartridge, the view illustrating the process of rotation of the detection gear from the initial position to the second rotational position.
Figure 10C:
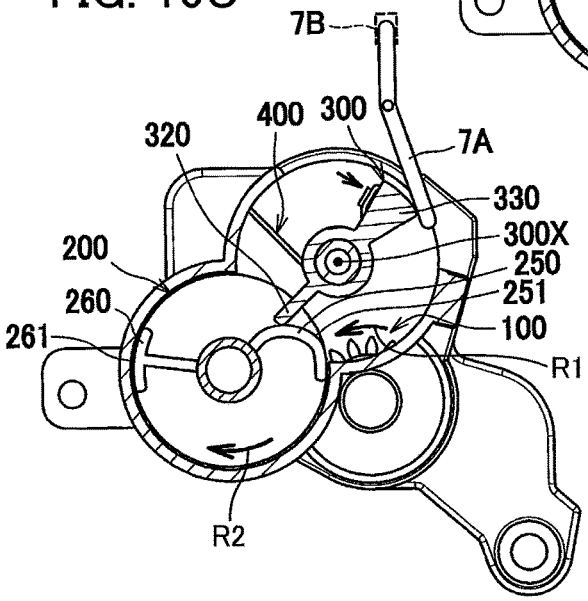
FIG. 10C is a view illustrating the detection gear and the detection lever as viewed from the outside of the developing cartridge, the view illustrating the process of rotation of the detection gear from the initial position to the second rotational position.

When the detection gear 200 is at the second rotational position illustrated in FIG. 10C, the contact between the first protrusion 250 and the detection lever 300 is released, thereby causing the detection lever 300 to be positioned at the first position. When the detection gear 200 is at the third rotational position illustrated in FIG. 11B, the contact between the second protrusion 260 and the detection lever 300 is released, thereby causing the detection lever 300 to be positioned at the first position. In these case, i.e., in a state where the detection lever 300 is positioned at the first position, the detection lever 300 is in contact with the main body lever 7A, and the main body lever 7A is positioned between the light-emitting portion and the light-receiving portion of the optical sensor 7B. As a result, light emitted from the light-emitting portion is shielded by the main body lever 7A to prevent the light-receiving portion from receiving the light emitted from the light-emitting portion.

The laser printer 1 identifies the specification of the developing cartridge 10 by making use of a detection signal obtained on the basis of changes between a state where the light-receiving portion receives light and a state where the light-receiving portion does not receive light.

Further, in the present embodiment, not only when the detection gear 200 is positioned at the initial position but also when the detection gear 200 is positioned at the final position, the detection lever 300 is in contact with the main body lever 7A. Thus, the laser printer 1 can determine, by using the detection lever 300, whether or not the developing cartridge 10 is attached to the laser printer 1.

Figure 7:
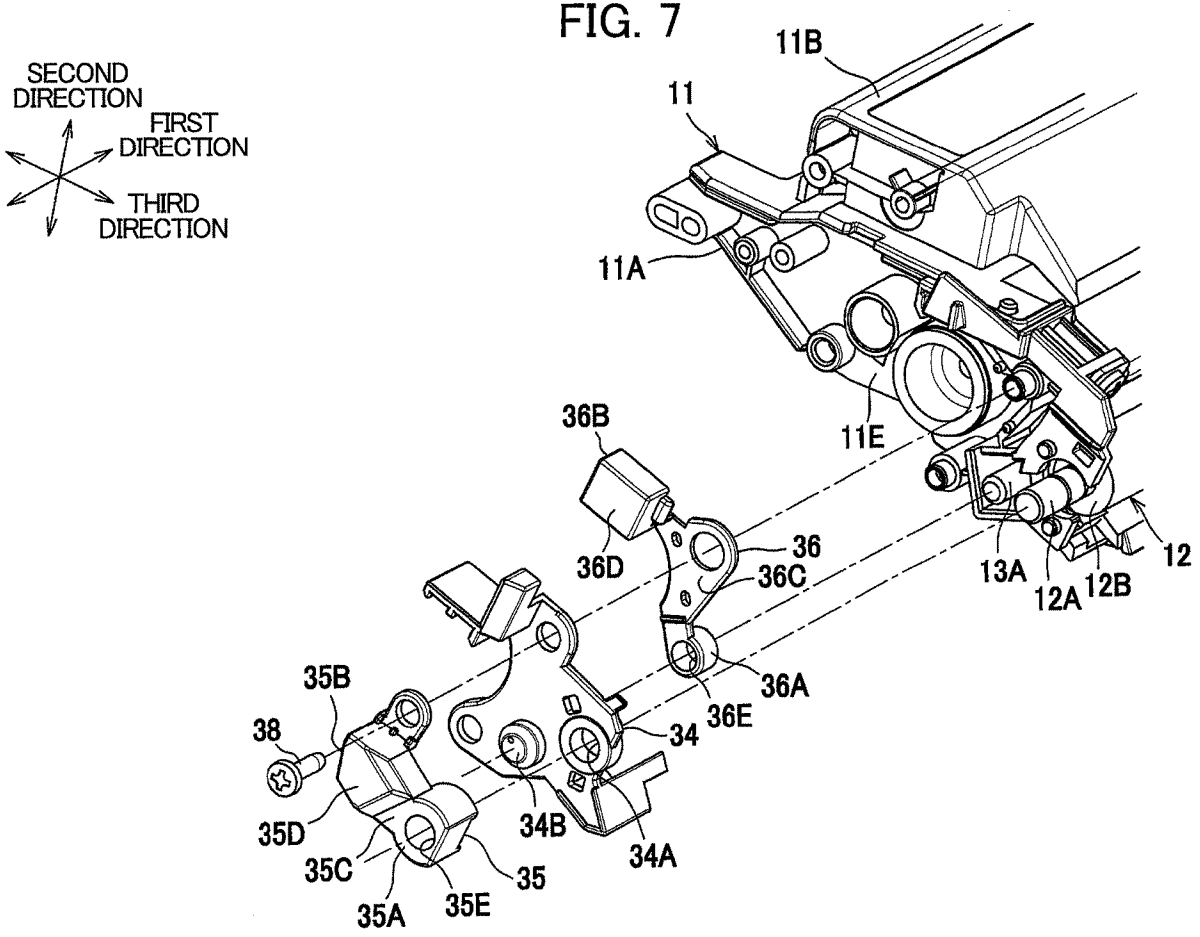
FIG. 7 is an exploded perspective view of parts of electrodes positioned at the other side in the first direction of the casing of the developing cartridge.

As illustrated in FIG. 7, the second bearing member 34 includes a first support portion 34A and a second support portion 34B. The first support portion 34A rotatably supports the developing roller shaft 12A. The second support portion 34B rotatably supports the supply roller shaft 13A. In a state where the second bearing member 34 supports the developing roller shaft 12A and the supply roller shaft 13A, the second bearing member 34 is fixed to the outer surface 11E at the other side of the container 11A of the casing 11 in the first direction.

The developing electrode 35 is positioned at the other side of the casing 11 in the first direction. That is, the developing electrode 35 is positioned at the outer surface 11E. The developing electrode 35 is configured to supply electric power to the developing roller shaft 12A. For example, the developing electrode 35 is made of electrically conductive resin.

The developing electrode 35 includes a first electrical contact 35A, a second electrical contact 35B, and a connection portion 35C. The first electrical contact 35A is in contact with the developing roller shaft 12A. The connection portion 35C couples the first electrical contact 35A and the second electrical contact 35B to thereby electrically connect the first electrical contact 35A and the second electrical contact 35B.

The first electrical contact 35A has a contact hole 35E. The developing roller shaft 12A is inserted into the contact hole 35E. Preferably, the contact hole 35E is a circular hole. In a state where the developing roller shaft 12A is inserted into the contact hole 35E, the first electrical contact 35A is in contact with a portion of the developing roller shaft 12A. Specifically, in the state where the developing roller shaft 12A is inserted into the contact hole 35E, the first electrical contact 35A is in contact with the outer circumferential surface of the developing roller shaft 12A.

The second electrical contact 35B of the developing electrode 35 includes a developing contact surface 35D extending in the second direction and the third direction.

The supply electrode 36 is positioned at the other side of the casing 11 in the first direction. That is, the supply electrode 36 is positioned at the outer surface 11E. The supply electrode 36 is configured to supply electric power to the supply roller shaft 13A. For example, the supply electrode 36 is made of electrically conductive resin.

The supply electrode 36 includes a third electrical contact 36A, a fourth electrical contact 36B, and a connection portion 36C. The third electrical contact 36A is in contact with the supply roller shaft 13A. The connection portion 36C couples the third electrical contact 36A and the fourth electrical contact 36B to thereby electrically connect the third electrical contact 36A and the fourth electrical contact 36B.

The third electrical contact 36A has a contact hole 36E. The supply roller shaft 13A is inserted into the contact hole 36E. Preferably, the contact hole 36E is a circular hole. In a state where the supply roller shaft 13A is inserted into the contact hole 36E, the third electrical contact 36A is in contact with a portion of the supply roller shaft 13A. Specifically, in the state where the supply roller shaft 13A is inserted into the contact hole 36E, the third electrical contact 36A is in contact with the outer circumferential surface of the supply roller shaft 13A.

The fourth electrical contact 36B of the supply electrode 36 includes a supply contact surface 36D extending in the second direction and the third direction.

The developing electrode 35 and the supply electrode 36 are fixed, together with the second bearing member 34, to the outer surface 11E at the other side of the casing 11 in the first direction with a screw 38.

Figure 8:
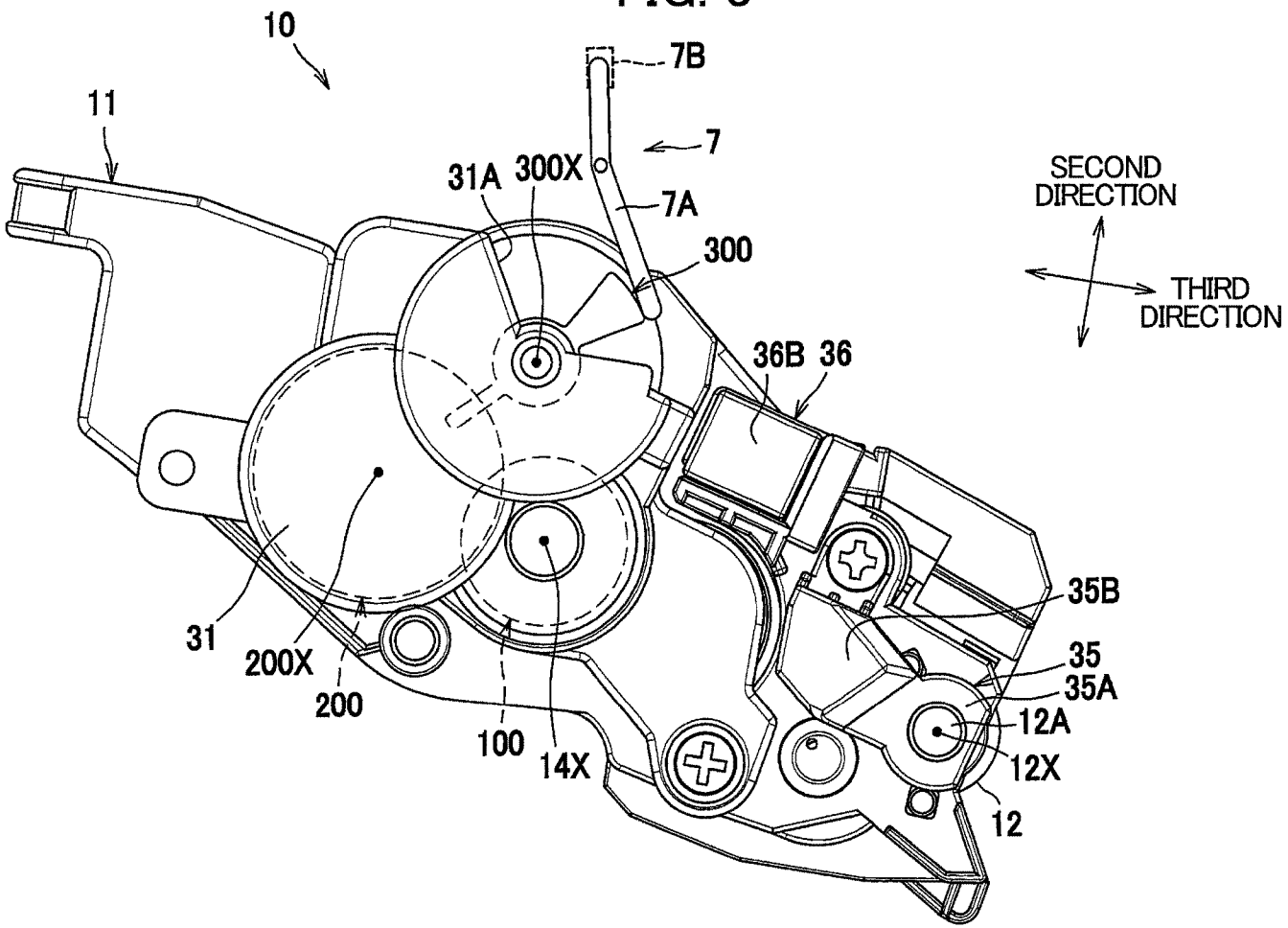
FIG. 8 is a side view illustrating the other side in the first direction of the developing cartridge.

As illustrated in FIG. 8, the second electrical contact 35B of the developing electrode 35 is positioned closer to the developing roller shaft 12A in the third direction than the second agitator gear 100 is to the developing roller shaft 12A. The second electrical contact 35B is positioned farther from the developing roller shaft 12A in the third direction than the first electrical contact 35A is from the developing roller shaft 12A.

The fourth electrical contact 36B of the supply electrode 36 is positioned closer to the developing roller shaft 12A in the third direction than the second agitator gear 100 is to the developing roller shaft 12A. Further, the fourth electrical contact 36B is positioned farther from the developing roller shaft 12A in both the second direction and the third direction than the second electrical contact 35B is from the developing roller shaft 12A.

The detection gear 200 is positioned farther from the developing roller shaft 12A in the third direction than the second electrical contact 35B is from the developing roller shaft 12A. The detection gear 200 is positioned farther from the developing roller shaft 12A in the third direction than the fourth electrical contact 36B is from the developing roller 12A.

The second axis 200X of the detection gear 200 is positioned farther from the developing roller shaft 12A in the third direction than the first axis 14X of the second agitator gear 100 is from the developing roller shaft 12A. In other words, the detection gear 200 is positioned at another end portion of the casing 11 in the third direction.

The third axis 300X of the detection lever 300 is positioned closer to the developing roller shaft 12A in the third direction than the second axis 200X of the detection gear 200 is to the developing roller shaft 12A. The third axis 300X is positioned farther from the developing roller shaft 12A in the third direction than the second electrical contact 35B is from the developing roller shaft 12A. The third axis 300X is positioned farther from the developing roller shaft 12A in the third direction than the fourth electrical contact 36B is from the developing roller shaft 12A. The third axis 300X is positioned farther from the developing roller shaft 12A in the second direction than the first axis 14X of the second agitator gear 100 is from the developing roller shaft 12A. The third axis 300X is positioned farther from the developing roller shaft 12A in the second direction than the second axis 200X of the detection gear 200 is from the developing roller shaft 12A.

Functions and effects of the developing cartridge 10 configured as described above will be described. For attaching the developing cartridge 10 to the laser printer 1, the developing cartridge 10 is moved toward the inside of the main body housing 2 in the third direction with the developing roller 12 in the lead, as illustrated in FIG. 1.

Further, when the developing cartridge 10 is in an unused state as illustrated in FIG. 1, the detection lever 300 is positioned at the first position. Thus, the leading end of the lever contact portion 330 of the detection lever 300 contacts the main body lever 7A to cause the main body lever 7A to swingably move. As described above, when the optical sensor 7B detects displacement of the main body lever 7A, the control device CU can determine that the developing cartridge 10 is attached.

As illustrated in FIG. 9A, in a state where the detection gear 200 is positioned at the initial position, the detection gear 200 is urged in the rotational direction of the detection gear 200 by the torsion spring 500. However, since one of the plurality of gear teeth 221 of the second gear portion 220 is in contact with one of the plurality of gear teeth 111 of the first gear portion 110 and thus the detection gear 200 is prevented from rotating, the detection gear 200 cannot rotate.

When the laser printer 1 starts to be driven according to an instruction from the control device CU, the coupling 22 illustrated in FIG. 4 rotates to rotate the first agitator gear 25 through the idle gear 26. By this rotation of the first agitator gear 25, the second agitator gear 100 positioned at the other side of the casing 11 in the first direction is rotated in an arrow direction R1 (FIG. 9A) via the agitator shaft 14A.

As illustrated in FIGS. 9A and 9B, when the second agitator gear 100 rotates in the arrow direction R1, the rotational force of the second agitator gear 100 is transmitted to the detection gear 200. As a result, the detection gear 200 rotates in an arrow direction R2 in accordance with the rotation of the second agitator gear 100.

Upon the rotation of the detection gear 200 in the arrow direction R2, the first contact surface 251 of the first protrusion 250 contacts the leading end of the gear contact portion 320 of the detection lever 300.

Then, when the detection gear 200 further rotates, the first contact surface 251 moves the detection lever 300 from the first position to the second position against the urging force of the torsion spring 400, as illustrated in FIG. 10A. By this movement of the detection lever 300 to the second position, the leading end of the lever contact portion 330 is separated from the main body lever 7A to be out of contact with the main body lever 7A. As a result, the main body lever 7A is no longer positioned between the light-emitting portion and the light-receiving portion of the optical sensor 7B, and thus the signal received by the light-receiving portion is changed.

Thereafter, when the detection gear 200 further rotates, as illustrated in FIGS. 10B and 10C, the torsion spring 400 moves the detection lever 300 from the second position to the first position by the urging force of the torsion spring 400 in a state where the first contact surface 251 is in contact with the leading end of the gear contact portion 320 of the detection lever 300.

Upon the movement of the detection lever 300 from the second position to the first position, the leading end of the lever contact portion 330 contacts the main body lever 7A. As a result, the main body lever 7A is positioned between the light-emitting portion and the light-receiving portion of the optical sensor 7B, and thus the signal received by the light-receiving portion is changed.

At this time, the detection lever 300 moves from the second position to the first position at a first speed. This is because the leading end of the gear contact portion 320 is in contact with the first contact surface 251 during the movement of the detection lever 300 from the second position to the first position.

The first speed is lower than a second speed. The second speed is a moving speed of the detection lever 300 when the detection lever 300 moves from the second position to the first position by the urging force of the torsion spring 400 in a state where the leading end of the gear contact portion 320 of the detection lever 300 is out of contact with the first contact surface 251.

The first speed is determined by the shape of the first contact surface 251. The moving speed of the detection lever 300 such as the first speed or second speed is, for example, an angular speed of the leading end of the lever contact portion 330 about the third axis 300X.

The main body lever 7A is pushed and moved by movement of the detection lever 300 from the second position to the first position. Accordingly, when the detection lever 300 moves from the second position to the first position at the lower first speed, the main body lever 7A also moves at a low speed to a position between the light-emitting portion and the light-receiving portion of the optical sensor 7B.

Thereafter, when the detection gear 200 further rotates from the state illustrated in FIG. 10C, the contact between the first contact surface 251 and the detection lever 300 is released.

After then, when the detection gear 200 further rotates, the second contact surface 261 of the second protrusion 260 contacts the leading end of the gear contact portion 320 of the detection lever 300.

Then, when the detection gear 200 further rotates, the second contact surface 261 moves the detection lever 300 from the first position to the second position against the urging force of the torsion spring 400, as illustrated in FIG. 11A. Upon the movement of the detection lever 300 to the second position, the leading end of the lever contact portion 330 no longer contact the main body lever 7A. As a result, the main body lever 7A is no longer positioned between the light-emitting portion and the light-receiving portion of the optical sensor 7B, and thus the signal received by light-receiving portion is changed.

Figure 11B:
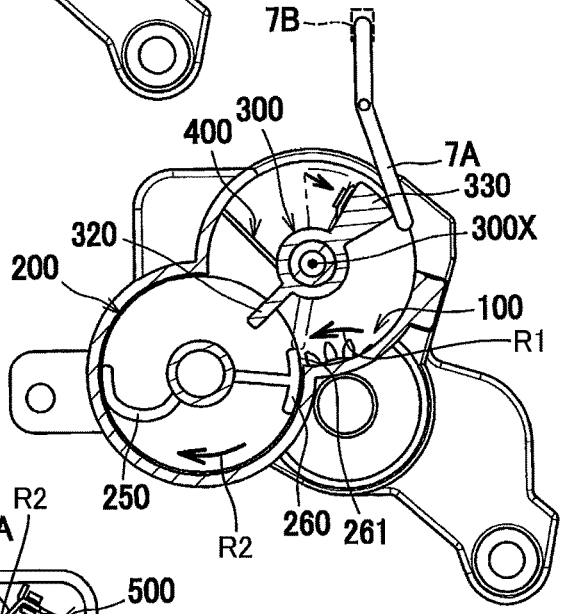
FIG. 11B is a view illustrating the detection gear and the detection lever as viewed from the outside of the developing cartridge, the view illustrating the process of rotation of the detection gear from the second rotational position to the third rotational position.

Thereafter, when the detection gear 200 further rotates, as illustrated in FIG. 11B, the contact between the second contact surface 261 and the detection lever 300 is released, and thus the torsion spring 400 moves the detection lever 300 from the second position to the first position by the urging force of the torsion spring 400. By this movement of the detection lever 300 to the first position, the leading end of the lever contact portion 330 contacts the main body lever 7A. As a result, the main body lever 7A is positioned between the light-emitting portion and the light-receiving portion of the optical sensor 7B (FIG. 11B), and thus the signal received by the light-receiving portion is changed.

At this time, the detection lever 300 moves from the second position to the first position by the urging force of the torsion spring 400 at the second speed higher than the first speed. This is because the leading end of the gear contact portion 320 is out of contact with the first contact surface 251 and the second contact surface 261 during the movement of the detection lever 300 from the second position to the first position. In this case, the main body lever 7A pushed and moved by the detection lever 300 also moves at a high speed to a position between the light-emitting portion and the light-receiving portion of the optical sensor 7B.

Figure 11C:
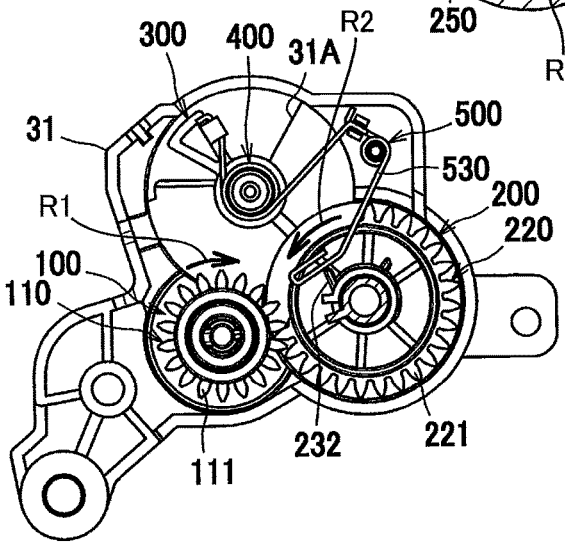
FIG. 11C is a view illustrating the detection gear and the detection lever as viewed from the inside of the developing cartridge, the view illustrating the process of rotation of the detection gear from the second rotational position to the third rotational position.

Thereafter, when the detection gear 200 further rotates form the state illustrated in FIG. 11C, the gear teeth 221 of the second gear portion 220 are separated from the gear teeth 111 of the first gear portion 110 of the second agitator gear 100 and thus the result that engagement between the second gear portion 220 and the first gear portion 110 is released. As a result, the rotational force of the second agitator gear 100 is no longer transmitted to the detection gear 200. However, at this time, the second arm 530 of the torsion spring 500 is in contact with the second spring engagement portion 232 of the detection gear 200 and applies a rotational force to the detection gear 200, thereby causing the detection gear 200 to rotate to the final position illustrated in FIGS. 12A and 12B.

At the final position of the detection gear 200, the gear teeth 111 of the first gear portion 110 of the second agitator gear 100 face the tooth-missing portion 221B of the detection gear 200 and thus engage with none of the plurality of gear teeth 221. Further, at the final position of the detection gear 200, the posture of the detection gear 200 is maintained by the urging force of the torsion spring 500 and the contact between the locking protrusion 11G and the locking protrusion 240. Thus, afterward, the detection gear 200 does not rotate even when the second agitator gear 100 rotates.

In the above operation process, the output of the optical sensor 7B is switched four times after the start of rotation of the detection gear 200. The output switching pattern (i.e., any one or any combination of: difference in length of an OFF signal or an ON signal; difference in the number of times of switching; and difference in the switching timing) can be changed by modifying at least one of the number of protrusions which rotate together with the detection gear 200 and the shapes of the protrusions. By associating in advance the signal pattern with the specification of the developing cartridge 10, the control device CU can identify the specification of the developing cartridge 10.

In a case where a used developing cartridge 10 is attached to the main body housing 2 of the laser printer 1, the leading end of the lever contact portion 330 of the detection lever 300 comes into contact with the main body lever 7A since, in the used developing cartridge 10, the detection gear 200 is positioned at the final position and the detection lever 300 is positioned at the first position. Accordingly, the control device CU can determine that the developing cartridge 10 is attached.

According to the above-described developing cartridge 10, the moving speed of the detection lever 300 can be made different between: a case where the detection gear 200 rotates from the initial position to the second rotational position; and a case where the detection gear 200 rotates from the second rotational position to the third rotational position. Specifically, in a case where the detection gear 200 rotates from the initial position to the second rotational position, the moving speed of the detection lever 300 can be made low. On the other hand, in a case where the detection gear 200 rotates from the second rotational position to the third rotational position, the moving speed of the detection lever 300 can be made high. As a result, motion of the gear structure can be diversified in response to the diversification of the specification of the developing cartridge 10.

While the embodiment of the present disclosure has been described, the present disclosure is not limited to the above embodiment, and various modifications can be made to the embodiment without departing from the scope of the disclosure.

In the above embodiment, the first protrusion 250 and the second protrusion 260 are formed integrally with the detection gear 200. However, each of the first protrusion 250 and the second protrusion 260 may be a different component formed separately from the detection gear 200. In this case, the detection gear may have a cam. Specifically, the detection gear may have such a configuration that the detection gear moves in accordance with rotation of the coupling to transit between a first state where the cam and the protrusion contact each other and a second state where the cam and the protrusion are separated from each other, and the protrusions are moved by the transition of the detection gear between the first state and the second state.

Figure 13A:
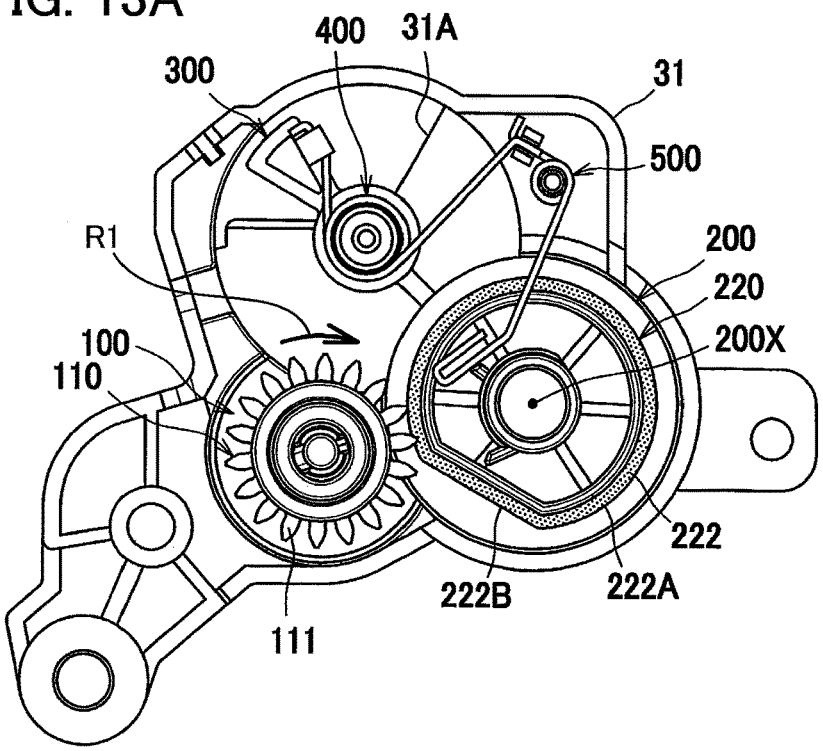
FIG. 13A is a view illustrating a detection gear of a developing cartridge according to a modified example of the embodiment.
Figure 13B:
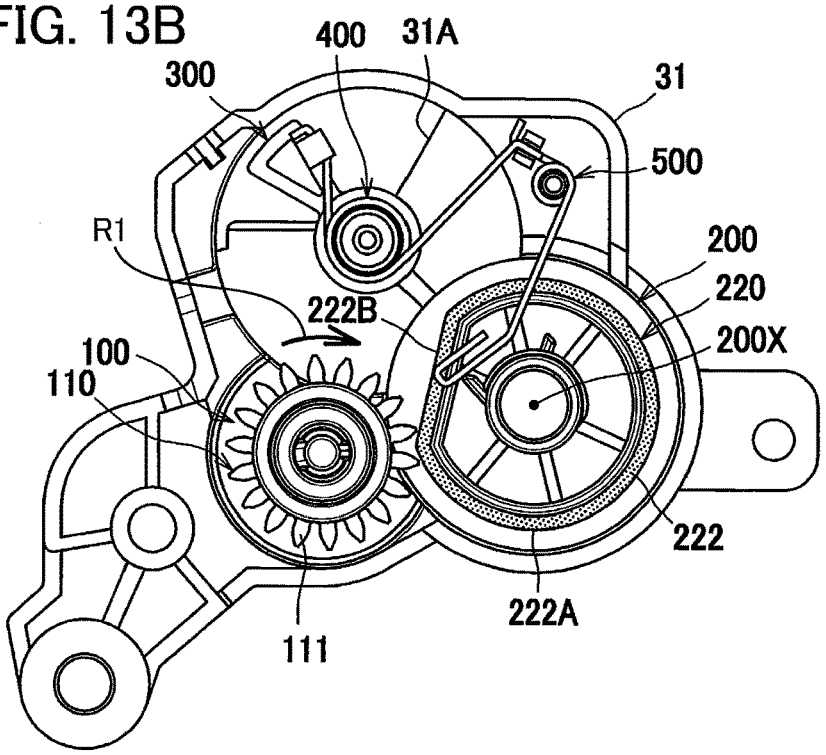
FIG. 13B is a view illustrating the detection gear of the developing cartridge according to the modified example of the embodiment.

In the above embodiment, the second gear portion 220 of the detection gear 200 includes the plurality of gear teeth 221. Alternatively, as illustrated in FIGS. 13A and 13B, the second gear portion 220 may include a friction member 222 in place of the gear teeth 221. The friction member 222 is positioned at the circumferential periphery of the detection gear 200.

The friction member 222 includes an engagement portion 222A and a non-engagement portion 222B. The engagement portion 222A is engageable with the plurality of gear teeth 111 of the second agitator gear 100. The non-engagement portion 222B does not engage with the plurality of gear teeth 111. The engagement portion 222A is positioned farther from the second axis 200X in the radial direction of the detection gear 200 than the non-engagement portion 222B is from the second axis 200X. The friction member 222 is made of, for example, rubber.

When the detection gear 200 rotates from the initial position to the third rotational position, the engagement portion 222A engages with the gear teeth 111 of the second agitator gear 100 as illustrated in FIG. 13A. Thus, when the second agitator gear 100 rotates, the detection gear 200 rotates in accordance with the rotation of the second agitator gear 100 by friction force between the gear teeth 111 and the friction member 222.

Further, as illustrated in FIG. 13B, when the detection gear 200 is positioned at the final position, the engagement between the engagement portion 222A and the gear teeth 111 is released. In other words, the first gear portion 110 of the second agitator gear 100 faces the non-engagement portion 222B. Thus, even when the second agitator gear 100 rotates, the detection gear 200 does not rotate from the final position. The second agitator gear 100 may also include a friction member in place of the gear teeth 111.

In the above embodiment, the first gear portion 110 is provided over the entire circumferential periphery of the second agitator gear 100, and the second gear portion 220 is provided only at a portion of the circumferential periphery of the detection gear 200. However, the configurations of the first gear portion 110 and the second gear portion 220 are not limited to the above configurations. For example, the first gear portion 110 may be provided over only a portion of the circumferential periphery of the second agitator gear 100, and the second gear portion 220 may be provided over the entire circumferential periphery of the detection gear 200.

In the above embodiment, the detection lever 300 is swingably supported by the second gear cover 31. Alternatively, the detection lever 300 may be swingably supported by the casing 11. Further, the detection lever 300 may be swingably supported by both the casing 11 and the second gear cover 31. For example, the casing 11 includes a second lever shaft extending in the first direction and positioned at the outer surface 11E. In this example, the second lever shaft is inserted into the hole 310 of the tubular portion 315 from one side in the axial direction, and the lever shaft 31B of the second gear cover 31 is inserted into the hole 310 from the other side in the axial direction, thereby enabling the detection lever 300 to swingably move about the lever shaft 31B and the second lever shaft.

In the above embodiment, the detection lever 300 is swingably movable about the third axis 300X. Alternatively, the detection lever 300 may move linearly.

In the above embodiment, the agitator shaft 14A is employed as an example of the shaft. However, the shaft may be, in place of the agitator shaft 14A, a shaft which is only for transmitting drive force from the one side to the other side of the casing 11 in the first direction.

In the above embodiment, the second agitator gear 100 is employed as an example of the first gear. However, the first gear may be a component formed separately from the second agitator gear 100. That is, the first gear may be a gear different from a gear attached to the agitator shaft 14A. Further, the coupling, the first gear, the second gear, and the lever may be positioned at the same side of the casing in the first direction.

In the above embodiment, the torsion spring 400 is employed as an example of the first urging member. However, the first urging member may be a spring other than the torsion spring. Further, the first urging member may be a member other than a spring as long as the member has elasticity. For example, the first urging member may be rubber. The same is true with respect to the second urging member. The developing cartridge may have a configuration that does not include the second urging member.

In the first embodiment, the initial position is taken as an example of the first rotational position. Alternatively, the first rotational position may be a position other than the initial position. For example, the first rotational position may be a position between the initial position and the second rotational position in the above embodiment. Further, the final position is taken as an example of the fourth rotational position. However, the fourth rotational position may be a position other than the final position. For example, the fourth rotational position may be a position the same as the third rotational position.

In the above embodiment, the developing cartridge 10 is separately formed from the photosensitive cartridge 5. Alternatively, the developing cartridge 10 may be integrally formed with the photosensitive cartridge 5.

In the above embodiment, the monochrome laser printer 1 is taken as an example of the image forming apparatus.

However, the image forming apparatus may be a color image forming apparatus, an apparatus that performs exposure using an LED, a copier, or a multifunction machine.

The elements in the embodiment and modifications thereof may be arbitrarily combined in the implementation.

What is claimed is:

1. A developing cartridge comprising:

a casing configured to accommodate therein developing agent;

a lever movable relative to the casing between a first position and a second position, the lever being positioned at an outer surface of the casing;

a first urging member configured to urge the lever toward the first position;

a first gear rotatable about a first axis extending in a first direction, the first gear being positioned at the outer surface of the casing;

a second gear rotatable about a second axis extending in the first direction from a first rotational position to a second rotational position and further from the second rotational position to a third rotational position, the second gear being positioned at the outer surface, the second gear rotating in accordance with rotation of the first gear in a case where the second gear is in engagement with the first gear;

a first protrusion rotatable together with the second gear, the first protrusion having a first contact surface configured to contact the lever; and a second protrusion rotatable together with the second gear, the second protrusion being positioned away from the first protrusion in a rotational direction of the second gear, the second protrusion having a second contact surface extending in the rotational direction, the second contact surface being configured to contact the lever, wherein, in a case where the second gear rotates from the first rotational position to the second rotational position, the first contact surface contacts the lever to move the lever from the first position to the second position against urging force of the first urging member, and then the lever moves at a first speed from the second position to the first position in a state where the first contact surface contacts the lever, wherein, in a case where the second gear is positioned at the second rotational position, the contact between the first contact surface and the lever is released, wherein, in a case where the second gear rotates from the second rotational position to the third rotational position, the second contact surface contacts the lever to move the lever from the first position to the second position against the urging force of the first urging member, and wherein, in a case where the second gear is positioned at the third rotational position, the contact between the second contact surface and the lever is released, and the lever moves at a second speed higher than the first speed from the second position to the first position by the urging force of the first urging member.

2. The developing cartridge according to claim 1, wherein the first contact surface extends in a direction opposite to the rotational direction of the second gear, and further extends inward in a radial direction of the second gear.

3. The developing cartridge according to claim 2, wherein the first contact surface has a first end portion and a second end portion in the rotational direction of the second gear, the second end portion being positioned away from the first end portion in the rotational direction of the second gear, the second end portion being positioned closer to the second axis in the radial direction of the second gear than the first end portion is to the second axis.

4. The developing cartridge according to claim 1, wherein the first contact surface has a curved shape which is convex in a direction opposite to the rotational direction of the second gear.

5. The developing cartridge according to claim 1, further comprising a cover covering at least a portion of the lever and positioned at the outer surface, wherein the lever is supported by one of the casing and the cover.

6. The developing cartridge according to claim 5, wherein the cover includes a lever shaft extending in the first direction, wherein the lever has a hole into which the lever shaft is inserted, and wherein the lever is swingably movable about the lever shaft.

7. The developing cartridge according to claim 5, wherein the cover has an opening, and wherein at least a portion of the lever is exposed through the opening.

8. The developing cartridge according to claim 1, wherein the lever is swingably movable about a third axis extending in the first direction.

9. The developing cartridge according to claim 1, wherein the second gear is rotatable from the third rotational position to a fourth rotational position, the second gear including a gear portion positioned at a portion of a circumferential periphery of the second gear, wherein, in a case where the second gear rotates from the first rotational position to the third rotational position, the gear portion engages with the first gear, and wherein, in a case where the second gear is positioned at the fourth rotational position, the engagement between the gear portion and the first gear is released.

10. The developing cartridge according to claim 9, wherein the gear portion includes a plurality of gear teeth.

11. The developing cartridge according to claim 9, wherein the gear portion include a friction member.

12. The developing cartridge according to claim 11, wherein the friction member is a rubber.

13. The developing cartridge according to claim 9, further comprising a second urging member configured to hold the second gear at the fourth rotational position.

14. The developing cartridge according to claim 13, wherein the second urging member is a spring.

15. The developing cartridge according to claim 14, further comprising a cover covering at least a portion of the lever, the cover being positioned at the outer surface, wherein the spring is a torsion spring, the torsion spring including:

a coil portion;

a first arm extending from one end of the coil portion; and a second arm extending from another end of the coil portion, wherein the first arm is fixed to one of the casing and the cover, and wherein the second arm is configured to contact the second gear.

16. The developing cartridge according to claim 1, further comprising a developing roller rotatable about a fourth axis extending in the first direction.

17. The developing cartridge according to claim 1, further comprising:

a coupling rotatable about a fifth axis extending in the first direction, the coupling being positioned at one side of the casing in the first direction; and a shaft extending in the first direction, the shaft rotating in accordance with rotation of the coupling, wherein the first gear is positioned at another side of the casing in the first direction, the first gear being rotatable together with the shaft, and wherein the second gear and the lever are positioned at the another side of the casing in the first direction.

18. The developing cartridge according to claim 17, wherein the first gear is mounted to the shaft.

19. The developing cartridge according to claim 17, further comprising an agitator configured to agitate the developing agent, the agitator including the shaft.

20. The developing cartridge according to claim 1, further comprising an agitator configured to agitate the developing agent, the agitator being rotatable about the first axis and including a shaft extending in the first direction, wherein the first gear is rotatable together with the shaft.

21. The developing cartridge according to claim 20, wherein the first gear is mounted to the shaft.

22. The developing cartridge according to claim 1, wherein, in a state where the developing cartridge is attached to an image forming apparatus, the lever is in contact with a portion of the image forming apparatus in a case where the lever is positioned at the first position, while the lever is out of contact with the portion of the image forming apparatus in a case where the lever is positioned at the second position.

23. The developing cartridge according to claim 1, wherein the first urging member is a spring.

24. The developing cartridge according to claim 23, further comprising a cover covering at least a portion of the lever, the cover being positioned at the outer surface, wherein the spring is a torsion spring, the torsion spring including:

a coil portion;

a first arm extending from one end of the coil portion; and a second arm extending from another end of the coil portion, wherein the first arm is fixed to one of the casing and the cover, and wherein the second arm is in contact with the lever.

* * * * *